US011760554B2

(12) United States Patent
Jo (Zee) et al.

(10) Patent No.: US 11,760,554 B2
(45) Date of Patent: Sep. 19, 2023

(54) MIXING CONTAINER AND SPRAY CONTAINER INCLUDING MIXING CONTAINER

(71) Applicant: CROWN COMPANY LIMITED, Kanagawa (JP)

(72) Inventors: Min (Kenneth Min) Jo (Zee), Kanagawa (JP); Mitsuhiro (Vincent) Jo (Zee), Kanagawa (JP)

(73) Assignee: CROWN COMPANY LIMITED, Kanagawa (JP)

( * ) Notice: Subject to any disclaimer, the term of this patent is extended or adjusted under 35 U.S.C. 154(b) by 946 days.

(21) Appl. No.: 16/715,890

(22) Filed: Dec. 16, 2019

(65) Prior Publication Data

US 2020/0115137 A1 Apr. 16, 2020

Related U.S. Application Data

(63) Continuation of application No. PCT/JP2019/012848, filed on Mar. 26, 2019.

(30) Foreign Application Priority Data

May 29, 2018 (JP) ..... 2018-102746

(51) Int. Cl.
*B65D 81/32* (2006.01)
*B05B 7/04* (2006.01)
(Continued)

(52) U.S. Cl.
CPC ..... *B65D 81/3222* (2013.01); *B01F 21/30* (2022.01); *B01F 35/7131* (2022.01);
(Continued)

(58) Field of Classification Search
CPC ..... B65D 81/3205
(Continued)

(56) References Cited

U.S. PATENT DOCUMENTS 4,779,722 A * 10/1988 Hall ..... B65D 55/06 215/DIG. 8
5,529,216 A 6/1996 Klima et al.
(Continued)

FOREIGN PATENT DOCUMENTS

CN 1533346 A 9/2004
CN 201873163 U 6/2011
(Continued)

OTHER PUBLICATIONS

Office Action issued in Chinese Patent Application No. 201980003238.0 dated Mar. 18, 2021, with English Translation of Examiner's Remarks (6 pages).
(Continued)

*Primary Examiner* — David L Sorkin
(74) *Attorney, Agent, or Firm* — Nakanishi IP Associates, LLC

(57) ABSTRACT

A mixing container includes a body having an upper opening and containing a dissolving agent, at least one receiving chamber protruding outward from an inner peripheral surface of the body, having a hollow defined in the protrusion where a press-through pack (PTP) sheet is fittable from inside the body, and formed from a flexible material, a support including a plate and a releasing hole that communicates with an inlet of the hollow in the receiving chamber when the plate is installed on the inner peripheral surface of the body and allows a substance stored in the PTP sheet to be released into the body, and holds an edge of the PTP sheet between the inner peripheral surface of the body and the plate, and a holding structure that holds the support on the inner peripheral surface of the body.

7 Claims, 14 Drawing Sheets

(51) Int. Cl.

| | |
|---|---|
| ***B65D 23/00*** | (2006.01) |
| ***B65D 75/36*** | (2006.01) |
| ***B01F 21/00*** | (2022.01) |
| ***B01F 35/71*** | (2022.01) |

(52) U.S. Cl.
CPC ..... *B01F 35/7132* (2022.01); *B05B 7/0408* (2013.01); *B65D 23/006* (2013.01); *B65D 75/367* (2013.01); *B65D 81/3205* (2013.01); *B01F 21/4021* (2022.01)

(58) Field of Classification Search
USPC ..... 206/219, 222; 366/130
See application file for complete search history.

(56) References Cited

U.S. PATENT DOCUMENTS

| | | | | |
|---|---|---|---|---|
| 5,836,479 | A | 11/1998 | Klima et al. | |
| 5,871,122 | A | 2/1999 | Klima et al. | |
| 5,890,624 | A | 4/1999 | Klima et al. | |
| 5,944,223 | A | 8/1999 | Klima et al. | |
| 5,947,332 | A | 9/1999 | Klima, Jr. et al. | |
| 6,073,808 | A | 6/2000 | Klima et al. | |
| 6,431,402 | B1 | 8/2002 | Klima et al. | |
| 6,540,109 | B1 | 4/2003 | Klima et al. | |
| 6,783,035 | B2 | 8/2004 | Garcia et al. | |
| 6,997,351 | B2 * | 2/2006 | Cho | B65D 51/2835 222/83.5 |
| 8,662,294 | B2 * | 3/2014 | Benbassat | B65D 81/3205 215/227 |
| 2001/0011661 | A1 | 8/2001 | Klima et al. | |
| 2003/0038186 | A1 | 2/2003 | Klima et al. | |
| 2003/0071071 | A1 | 4/2003 | Garcia et al. | |
| 2004/0206773 | A1 | 10/2004 | Ede et al. | |
| 2008/0011779 | A1 | 1/2008 | Klima et al. | |
| 2008/0290059 | A1 * | 11/2008 | Benbassat | B65D 81/3205 215/6 |
| 2009/0188886 | A1 | 7/2009 | Troesch et al. | |
| 2009/0321295 | A1 | 12/2009 | Ede et al. | |
| 2010/0000887 | A1 * | 1/2010 | Troesch | B65D 51/2821 222/525 |
| 2015/0360844 | A1 * | 12/2015 | Frieden | B65D 81/3211 206/219 |

FOREIGN PATENT DOCUMENTS

| | | | |
|---|---|---|---|
| JP | S55-161863 | U | 11/1980 |
| JP | H03-043485 | U | 4/1991 |
| JP | H04-118333 | U | 10/1992 |
| JP | H10-273161 | A | 10/1998 |
| JP | 2000-217885 | A | 8/2000 |
| JP | 2002-509504 | A | 3/2002 |
| JP | 2005-280726 | A | 10/2005 |
| JP | 2009-195728 | A | 9/2009 |
| JP | 2017-132534 | A | 8/2017 |

OTHER PUBLICATIONS

International Search Report issued in PCT/JP2019/012848 dated Jun. 25, 2019 with English Translation (9 pages).
Written Opinion of International Searching Authority issued in PCT/JP2019/012848 dated Jun. 25, 2019 (6 pages).
Written Opinion of International Searching Authority issued in PCT/JP2019/012848 dated Jun. 25, 2019 (issued as International Preliminary Report on Patentability, Chapter I on Dec. 1, 2020) with English Translation (15 pages).

* cited by examiner

[図8]
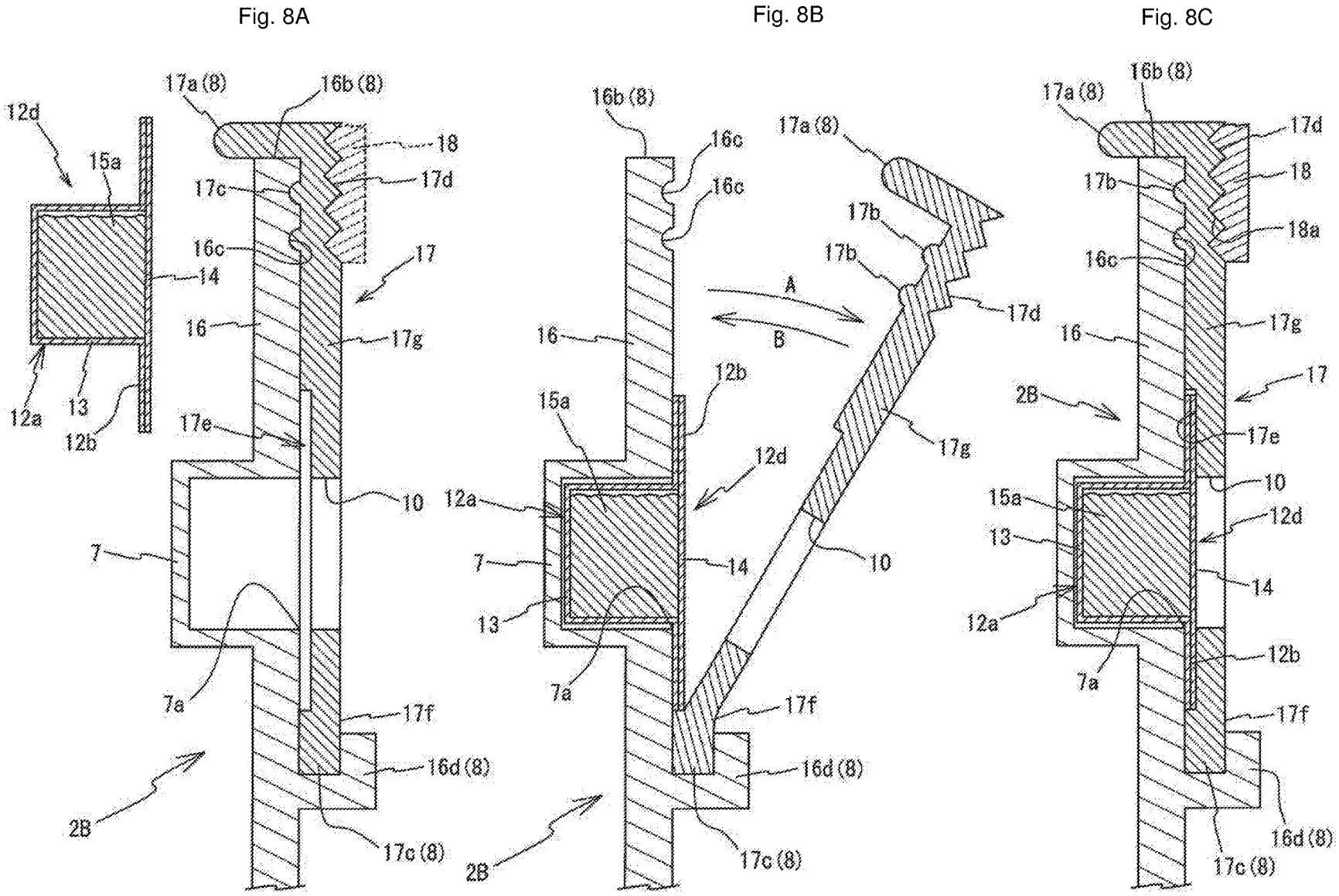

MIXING CONTAINER AND SPRAY CONTAINER INCLUDING MIXING CONTAINER

CROSS-REFERENCE TO RELATED APPLICATIONS

This application is a continuation application of International Patent Application No. PCT/JP2019/012848 filed on Mar. 26, 2019, which claims priority to Japanese Patent Application No. 2018-102746 filed on May 29, 2018, the entire contents of which are incorporated by reference.

BACKGROUND OF INVENTION

Field of the Invention

The present invention relates to a mixing container that allows a specified amount of dissolving target substance to be reliably fed into a dissolving agent in a body, and a spray container including the mixing container.

Background Art

Nowadays, household detergents and other solutions are often used at concentrations varied as appropriate for use purposes.

To change the concentration for a use purpose, the user measures powder or liquid detergent with a measuring spoon and mixes the measured detergent with liquid such as water.

To use such a prepared aqueous solution in a spray container, the user pours the measured solute and solvent into the spray container.

However, the opening of a spray container is typically small, and the user may accidentally spill the measured solute or solvent when pouring it into the spray container. This work is thus highly troublesome.

To avoid this, the user may mix the measured solute and solvent in a different container before placing the mixed solution into a spray container. However, such double work is also troublesome.

Although any known literature has yet to discuss the same issue as described herein, some relevant techniques are known as described below.

Patent Literature 1 entitled CONTAINER FOR DISCHARGING PRESSURIZED FLUID SUBSTANCE describes a technique for a discharging container that allows a liquid or another fluid substance to be contained under pressure in a sealed pressure-resistant container and allows the pressure-resistant container to be unsealed as appropriate to discharge the fluid substance.

For example, FIG. 5 in Patent Literature 1 shows a pressure-resistant container housing a package to be open by an external operation.

FIG. 6 in Patent Literature 1 also shows a pressure-resistant container with a plurality of separate areas storing different substances to be simultaneously released and mixed by an external operation.

The technique described in Patent Literature 1 enables the opening of a package prestored in a container or the release of the substances stored in separate areas in a container by an external operation, feeding the stored substances into the container.

Patent Literature 2, entitled PUMP-TYPE LIQUID DETERGENT REFILL CONTAINER WITH SEPARABLE CONTAINER BODY, describes a technique for a pump refill container for liquid detergent. The technique enables rebottling and refilling through a large opening and easy rebottling of a different type of detergent.

The technique described in Patent Literature 2 includes a filling body having a middle part separable into upper and lower parts that are screwed or fitted together.

The filling body with the structure described in Patent Literature 2 has a larger opening when separated, facilitating refilling with and rebottling of new liquid detergent to be poured without spilling. In particular, before the filling body is refilled with a different type of liquid detergent, the remaining liquid detergent can be easily removed through the large opening from the filling body, which is then washed. This easy removal and washing facilitate refilling the filling body with a different type of liquid detergent. With the technique described in Patent Literature 2, the separable middle part of the filling body enables repetitive use and easy handling, offering comfortable use. Additionally, the technique described in Patent Literature 2 can reduce the manufacturing costs.

CITATION LIST

Patent Literature

Patent Literature 1: Japanese Unexamined Utility Model Application Publication No. 3-43485

Patent Literature 2: Japanese Unexamined Patent Application Publication No. 2005-280726

The technique described in Patent Literature 1 may allow substances stored separately in a body to be released and mixed in the body by an external operation.

However, no specific technique is described, suggested, or mentioned for selectively releasing an intended one of the substances stored separately within the body and feeding the selectively released substance into the body by an external operation.

In the container shown in FIG. 6 of Patent Literature 1, the separately stored substances are released by needle punctures. Although liquids as separately stored substances can mix reliably, powder or solids molded from powder as stored substances can have difficulties in mixing reliably after the release.

Further, although the container shown in FIG. 5 in Patent Literature 1 is free from such difficulties for powder or liquid stored substances, the body is structurally difficult to reuse. When, for example, the mixture is detergent and the dissolving agent is water, a new container is to be prepared each time the detergent is diluted, but this is highly uneconomical.

Patent Literature 2 describes the body with the separable middle part. However, no technique is disclosed, suggested, or mentioned for selectively releasing an intended one of the few substances stored separately in the body and feeding the selectively released substance into the body by an external operation.

One or more aspects of the present invention are directed to a reusable mixing container that allows a specified amount of dissolving target substance (powder, liquid, or solid) to be released into a body by an external operation, and a spray container including the mixing container.

SUMMARY OF INVENTION

A mixing container according to a first aspect of the present invention includes a body having an upper opening and containing a dissolving agent, at least one receiving chamber protruding outward from an inner peripheral surface of the body, having a hollow in which a press-through pack (PTP) sheet or a blister pack sheet is fittable from inside the body, and including a flexible material, a support including a plate and a releasing hole that communicates with an inlet of the hollow when the plate is installed on the inner peripheral surface of the body and allows a substance stored in the PTP sheet to be released into the body, and holding an edge of the PTP sheet between the inner peripheral surface of the body and the plate, and a holding structure that holds the support on the inner peripheral surface of the body.

In the first aspect of the invention, the body can contain the PTP sheet and the dissolving agent. The receiving chamber can contain an individual storage pack on the PTP sheet in its hollow.

Additionally, the receiving chamber, formed from the flexible material, allows a storage pack of the PTP sheet to be indirectly compressed by the receiving chamber compressed from outside the body with the storage pack contained in the receiving chamber.

The support can fix the PTP sheet by holding the edge of the PTP sheet between the support and the inner peripheral surface of the body. This can prevent the storage pack contained in the receiving chamber from being forced into the body without being open when the receiving chamber is compressed from outside the body. The support, which also has the releasing hole communicating with the inlet of the receiving chamber, allows the film sealing the substance stored in the PTP sheet to burst in the releasing hole when the receiving chamber is compressed from outside the body, releasing the stored substance from the storage pack into the body.

The holding structure can hold the support on the inner peripheral surface of the body with the releasing hole communicating with the inlet of the receiving chamber.

The mixing container according to the first aspect of the invention allows the substance stored in the PTP sheet to be released into the body by an external operation.

The PTP sheet contained in the receiving chamber is easily replaceable after use, and thus the mixing container according to the first aspect of the invention is reusable.

A mixing container according a second aspect of the present invention is the mixing container according to the first aspect in which the holding structure includes a fitting structure for the body and the support.

The mixing container according to the second aspect of the invention also has the same advantageous effects as the first aspect of the invention. In addition, the holding structure including the fitting structure for the body and the support allows the support to be accurately held at the intended position on the inner peripheral surface of the body. This causes the inlet of the receiving chamber and the releasing hole of the support to reliably communicate with each other when the support is installed on the inner peripheral surface of the body.

A mixing container according a third aspect of the present invention is the mixing container according to the first aspect or the second aspect in which the body further includes a plurality of the receiving chambers that are arranged in series circumferentially around a middle part of the body, and the support is annular and further includes the releasing hole corresponding to the inlet of each of the receiving chambers and a reinforcement supporting the annular support across a hollow of the support.

The mixing container according to the third aspect of the invention is a more specific and detailed implementation of the first or second aspect of the invention, with the body including the multiple receiving chambers in its middle part.

In the third aspect of the invention, the releasing holes of the annular support can be aligned with the inlets of the multiple receiving chambers arranged in series around the middle part of the body, and the edge of the PTP sheet can be held between the support and the inner peripheral surface of the body. With this arrangement in the third aspect of the invention, any receiving chamber may be compressed from outside the body to cause the substance stored in the storage pack contained in the compressed receiving chamber to be reliably released into the body.

The reinforcement across the hollow of the annular support can prevent deformation and misalignment of the support when an external force is indirectly applied to the support. This can prevent the PTP sheet in the receiving chambers from being forced into the body without being open when the receiving chambers are compressed from outside the body. The reinforcement may also be used as a handle for removing or attaching the support to replace the PTP sheet contained in the hollows of the receiving chambers after use.

Thus, the mixing container according to the third aspect of the invention allows an intended number of storage packs of the PTP sheet contained in the body to be open, releasing the stored substances into the body.

More specifically, when the body contains a fixed volume of dissolving agent, the concentration or percentage of the stored substance in the body increases as more storage packs are compressed by actions outside the body. Moreover, the concentration or percentage of the stored substance changes in fixed increments.

Thus, the structure according to the third aspect of the invention can facilitate the preparation of different mixtures with concentrations or percentages of the stored substance varying in fixed steps.

A mixing container according to a fourth aspect of the present invention is the mixing container according to the third aspect in which the body includes a first part having the receiving chambers, second parts other than the first part, and first connection sections into which the first part and the second parts are screwed together.

The mixing container according to the fourth aspect of the invention has the same advantageous effects as the third aspect of the invention. In addition, the first and second parts of the body, which are removably connected at the first connection section, allow an opening of the body to be located near the receiving chamber.

In this case, the reduced distance between the receiving chamber and the opening of the body can facilitate installation of the PTP sheet into each receiving chamber and removal of the PTP sheet after use.

A mixing container according to a fifth aspect of the present invention is the mixing container according to the first aspect or the second aspect further including a lid attached to the opening of the body and having a first thread on an outer peripheral surface of a vertically lower end portion of the lid. The body further includes a fitting recess on the opening of the body and fittable on a vertically upper end of the support, a fitting receiving portion on the inner peripheral surface of the body and receiving a lower end of the support, and a second thread on the inner peripheral surface of the body and adjacent to the opening. The support further includes a third thread that circumferentially connects with the second thread when the support is fitted on the fitting recess of the body, and a flexible portion adjacent to an insertion portion of the lower end of the support to be received in the fitting receiving portion and allowing the support to be tilted toward a center of the body. The holding structure further includes a second connection section in which the first thread and the second and third threads are screwed together.

The mixing container according to the fifth aspect of the invention is a more specific and detailed implementation of the first or second aspect of the invention in which the support is installed within the body in parallel with the central axis of the body.

In the fifth aspect of the invention, the support can be positioned within the body by the vertically upper end of the support fitted on the fitting recess in the body. This allows the inlet of the receiving chamber and the releasing hole of the support to reliably communicate with each other.

The fitting receiving portion on the inner peripheral surface of the body can receive and hold the vertically lower end of the support.

The support, which has the third thread connecting with the second thread on the inner peripheral surface adjacent to the body opening, allows the lid to be screwed into the body opening with the support fitted on the inner peripheral surface of the body opening. More specifically, the body, the support, and the lid are integrated together by the first thread on the lid screwed into the continuous thread of the second and third threads. In this state, the vertically lower end portion of the lid presses the support against the inner peripheral surface of the body, holding the vertically upper end of the support. As a result, the support is fixed at both of its vertically upper and lower ends, holding the PTP sheet placed between the support and the inner peripheral surface of the body.

With the inlet of the receiving chamber in the body communicating with the releasing hole in the support, compressing the receiving chamber from outside the body breaks the film of the PTP sheet in the releasing hole, thus releasing the stored substance from the PTP sheet into the body.

In the fifth aspect of the invention, the flexible portion of the support allows the vertically upper end of the support to be reversibly tilted toward the center of the body with respect to the flexible portion. The tilting allows the PTP sheet to be attached to or detached from the receiving chamber.

The mixing container according to the fifth aspect of the invention allows the substance stored in the PTP sheet installed in the body to be reliably released into the body.

A mixing container according to a sixth aspect of the present invention is the mixing container according to any one of the first to fifth aspects in which the body further includes a light transmissive material allowing an uppermost level of the dissolving agent to be visually observed from outside, and is graduated to indicate an amount of the contained dissolving agent.

The mixing container according to the sixth aspect of the invention also has the same advantageous effects as each of the first to fifth aspects. In addition, the body, which is formed from the light transmissive material and is graduated to indicate the amount of the contained dissolving agent, can facilitate the storage of a specified amount of dissolving agent into the body.

A mixing container according to a seventh aspect of the present invention is the mixing container according to any one of the first to sixth aspects in which the receiving chamber includes at least one protrusion extending from an inner surface defining the hollow in a direction of pressing the receiving chamber.

In the seventh aspect of the invention, the at least one protrusion extending in the hollow of the receiving chamber can compress the storage pack of the PTP sheet in the hollow of the receiving chamber when the receiving chamber is pressed to compress the receiving chamber toward the hollow from outside.

A spray container according to an eighth aspect of the present invention includes the mixing container according to any one of the first to seventh aspect, and a spray nozzle directly or indirectly installed in the mixing container according to any one of the first to seventh aspect.

The structure according to the eighth aspect of the invention allows the mixing container according to each of the first to seventh aspects of the invention to be also used as a spray container.

Thus, the structure according to the eighth aspect of the invention can improve the convenience and versatility of the structure according to each of the first to seventh aspects of the invention.

A press-through pack (PTP) sheet according to ninth aspect of the present invention is a PTP sheet for a mixing container including an upper opening and a holding structure for detachably holding the PTP sheet and releasably holding a substance stored in the PTP sheet, and having a hollow in which a dissolving agent is mixable with the stored substance. The PTP sheet includes a storage pack having a recessed cross section, having an integrated edge being a flange on a rim of the storage pack, and including a synthetic resin deformable by a finger operation, an inner pack having a recessed cross section, contained in the storage pack, and including a synthetic resin undeformable by a finger operation, the substance stored in the inner pack, which is powder or liquid, and a film sealing an opening of the storage pack storing the substance and the inner pack.

In the PTP sheet according to the ninth aspect of the invention, the outer pack, the film, and the stored substance are the same as in a known PTP sheet and have the same advantageous effects. The inner pack in the ninth aspect of the invention can store the substance within the storage pack. In addition, when the storage pack is pressed toward the hollow from outside, the inner pack can break the film with its opening, releasing the stored substance from the storage pack together with the inner pack.

Advantageous Effects

The mixing container according to the first aspect of the invention enables the opening of the PTP sheet within the body by an operation outside the body, releasing the substance stored in the PTP sheet into the body. This stored substance in the storage pack of the PTP sheet may be powder, liquid, or solid.

In the first aspect of the invention, after use of the substance contained in every storage pack of the PTP sheet, the PTP sheet used may be removed from the receiving chambers and replaced with a new PTP sheet. In this manner, the mixing container according to the first aspect of the invention may be reusable.

In the first aspect of the invention, when a mixture is accurately prepared in the body with a specified concentration or percentage, the use of PTP sheet eliminates a user operation of measuring the dissolving target substance (the substance stored in the PTP sheet).

Thus, the mixing container according to the first aspect of the invention facilitates the adjustment of the concentration or percentage of the dissolving target substance (the substance stored in the PTP sheet), allows the body to be used repeatedly, and is economical.

The mixing container according to the second aspect of the invention has the same advantageous effects as the first aspect of the invention. In addition, the holding structure, which includes the fitting structure for the body and the support, can facilitate positioning the support on the inner peripheral surface of the body.

The structure according to the second aspect of the invention thus facilitates the handling of the support and thus the mixing container according to the second aspect of the invention.

The mixing container according to the third aspect of the invention is a more specific implementation of the first or second aspect of the invention, with the body including multiple receiving chambers, and the receiving chambers and support arranged circumferentially around the middle part of the body.

The mixing container according to the third aspect of the invention has the same advantageous effects as the first or second aspect of the invention. In addition, when the user mixes the dissolving target substance (the substance stored in the PTP sheet) with the dissolving agent to prepare a mixture with a specified concentration or percentage, the user can achieve the specified concentration or percentage of the dissolving target substance (the substance stored in the PTP sheet) in the prepared mixture by simply opening the specified number of storage packs in the PTP sheet.

In this case, the mixture may be used for different purposes depending on the concentration. Thus, the third aspect of the invention enables accurate and easy preparation of mixtures with various concentrations or percentages.

The mixing container according to the fourth aspect of the invention has the same advantageous effects as the third aspect of the invention. In addition, the body, which is divisible into the first part including the receiving chambers and the other second parts, allows the PTP sheet used in each receiving chamber to be readily replaced with a new PTP sheet.

In the fourth aspect of the invention, the first and second parts, which are separable, are easy to wash.

The mixing container according to the fourth aspect of the invention is thus maintained in hygienic conditions. This improves the hygienic safety of a mixture prepared in the fourth aspect of the invention.

The mixing container according to the fifth aspect of the invention is a more specific implementation of the first or second aspect of the invention, with the receiving chambers and the support installed within the body in parallel with the central axis of the body.

In the fifth aspect of the invention, although the number of receiving chambers in the body is smaller than in the third aspect of the invention, the hollow of the body may have a smaller diameter than in the third aspect of the invention.

The structure according to the fifth aspect of the invention enables the production of a smaller and easily portable mixing container that has the same advantageous effects as the third aspect of the invention.

The mixing container according to the sixth aspect of the invention has the same advantageous effects as each of the first to fifth aspects of the invention. In addition, the mixing container allows the user to simultaneously measure and pour a dissolving agent into the body. The structure according to the sixth aspect of the invention thus facilitates mixing of the dissolving agent and the substance stored in the PTP sheet and adjustment of the concentration or percentage of the mixture.

Thus, the structure according to the sixth aspect of the invention allows the substance stored in the PTP sheet to mix with the dissolving agent more efficiently than the structure according to each of the first to fifth aspects of the invention.

In the seventh aspect of the invention, when the receiving chamber is pushed into its hollow, the protrusion extending in the receiving chamber can compress the storage pack of the PTP sheet.

The seventh aspect of the invention thus allows even a person with low finger strength (e.g., elderly people or children) to easily and reliably release the stored substance from the PTP sheet into the mixing container.

Thus, the structure according to the seventh aspect of the invention can further improve the operability of the mixing container.

The seventh aspect of the invention also reduces the likelihood that a stored substance partially remains in the storage pack when the stored substance is released from the PTP sheet into the mixing container. Thus, the structure according to the seventh aspect of the invention allows an appropriate amount of stored substance to be fed into the mixing container more reliably.

Thus, the mixing container according to the seventh aspect enables the preparation of a mixture with an intendedly adjusted concentration of stored substance with higher concentration accuracy.

The structure according to the seventh aspect of the invention can thus further improve the convenience of the mixing container.

The structure according to the eighth aspect of the invention allows the mixing container according to each of the first to seventh aspects of the invention to be also used as a spray container.

Thus, the structure according to the eighth aspect of the invention can further improve the convenience of each of the first to seventh aspects of the invention.

In the ninth aspect of the invention, when the storage pack of the PTP sheet is pressed into the hollow from outside, the inner pack can break the sealing film for the PTP sheet with its opening, releasing the stored substance without remains from the storage pack together with the inner pack.

With the PTP sheet according to the ninth aspect of the invention used for the mixing container according to the first to seventh aspects of the invention or the spray container according to the eighth aspect of the invention, the substance stored in the storage pack of the PTP sheet can be fed into the mixing container without remains.

In this case, when a mixture with an intendedly adjusted concentration is prepared in the mixing container according to the first to seventh aspects of the invention or the spray container according to the eighth aspect of the invention, the resultant mixture can have higher concentration accuracy.

Thus, the structure according to the ninth aspect of the invention allows an appropriate amount of stored substance to be fed reliably into the mixing container without any additional structural improvement in the mixing container according to the first to seventh aspects of the invention or the spray container according to the eighth aspect of the invention.

The structure according to the ninth aspect of the invention can thus further improve the convenience of the mixing container according to the first to seventh aspects of the invention or the spray container according to the eighth aspect of the invention.

BRIEF DESCRIPTION OF THE DRAWINGS

FIGS. 8A, 8B, and 8C are partial cross-sectional views of the mixing container according to the second embodiment of the present invention, describing the procedure for installing a PTP sheet into the receiving chamber.

DETAILED DESCRIPTION

A mixing container and a spray container including the mixing container according to embodiments of the present invention will now be described in detail with reference to FIGS. 1 to 14B.

First Embodiment

A mixing container and a spray container including the mixing container according to a first embodiment of the present invention will be described first with reference to FIGS. 1 to 5B.

Figure 1:
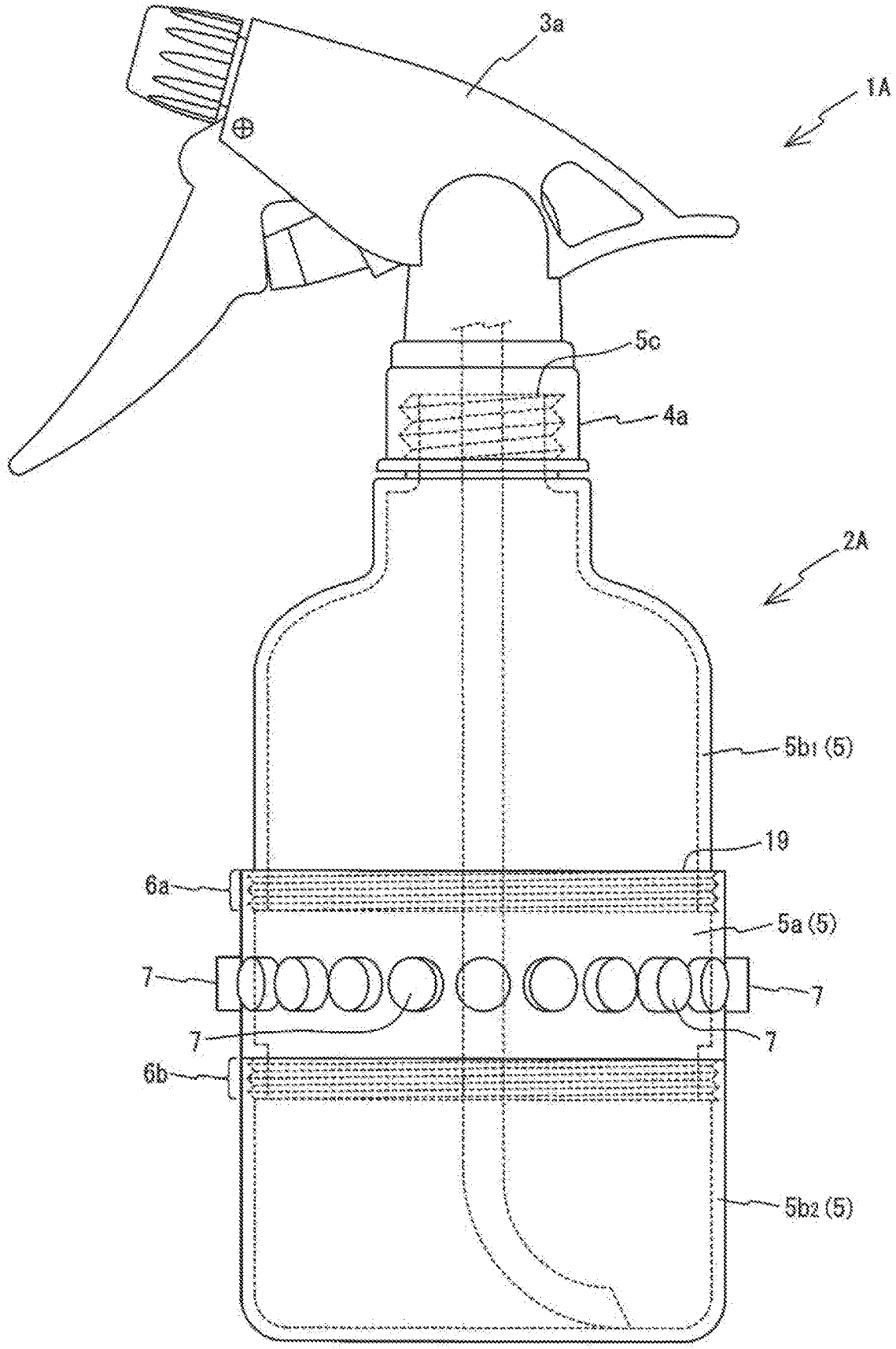
FIG. 1 is a side view of a mixing container and a spray container including the mixing container according to a first embodiment of the present invention.
Figure 2B:
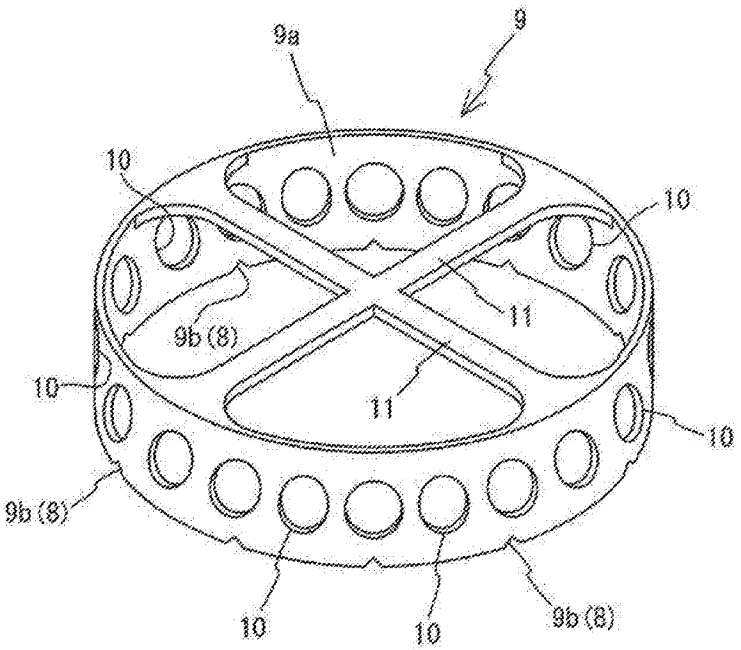
FIG. 2B is a perspective view of a support to be installed in the mixing container.
Figure 2A:
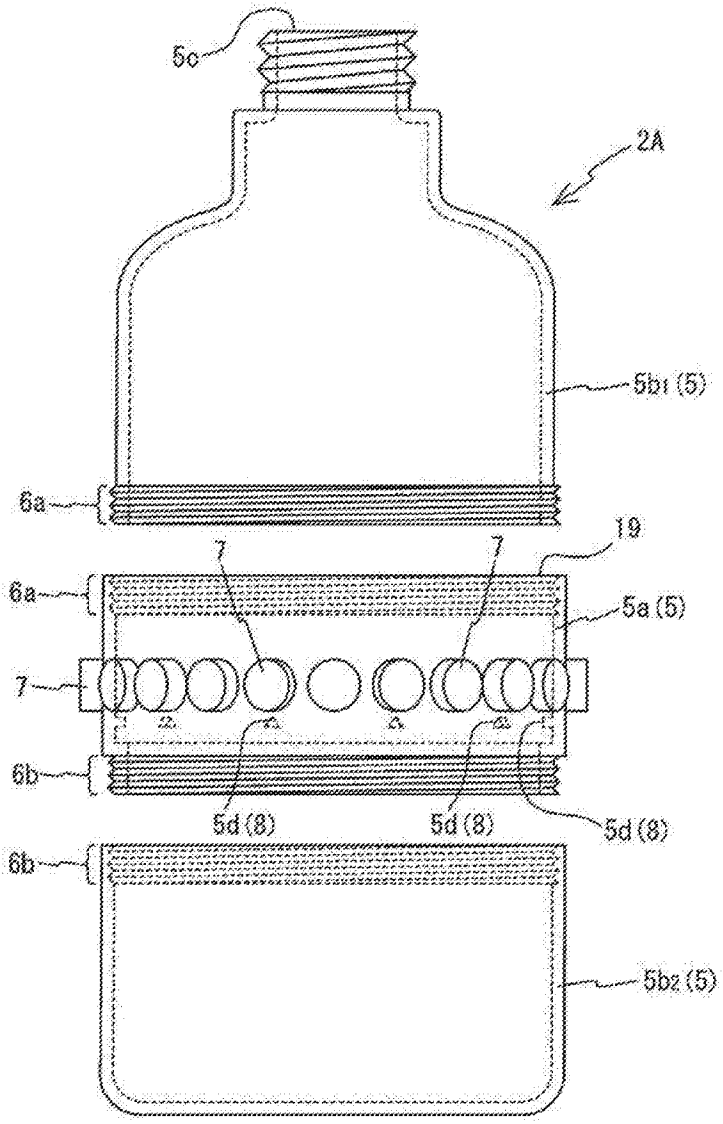
FIG. 2A is an exploded side view of the mixing container according to the first embodiment of the present invention.
Figure 3A:
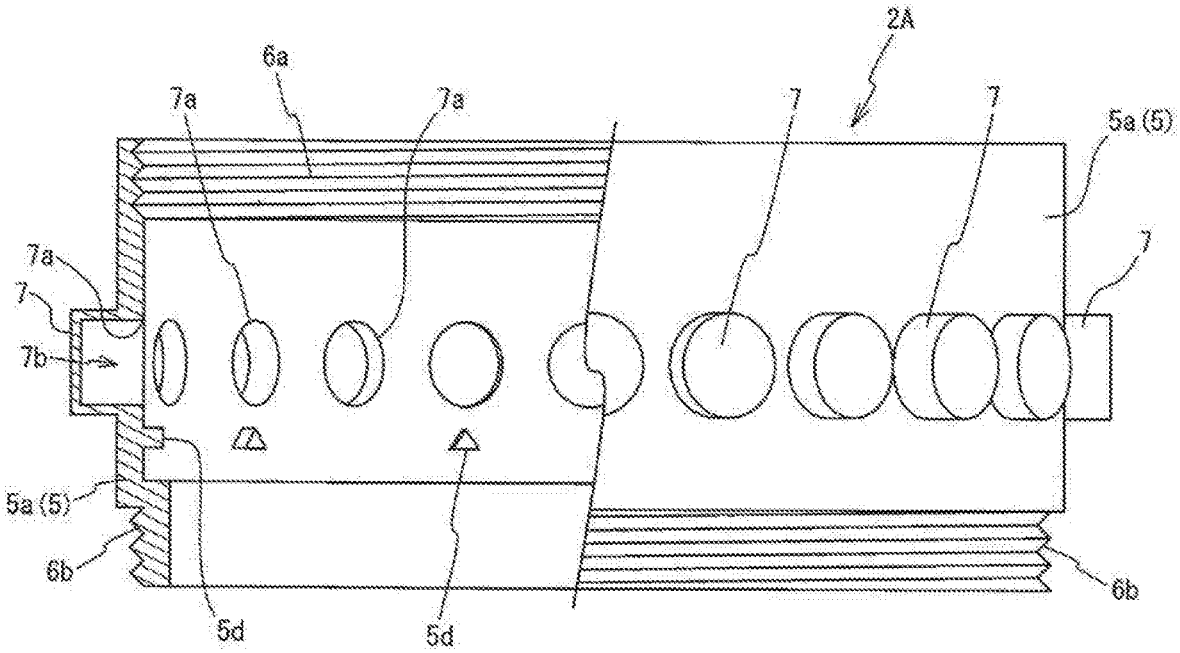
FIG. 3A is a cutaway side view of a first part of the mixing container according to the first embodiment of the present invention.
Figure 3B:
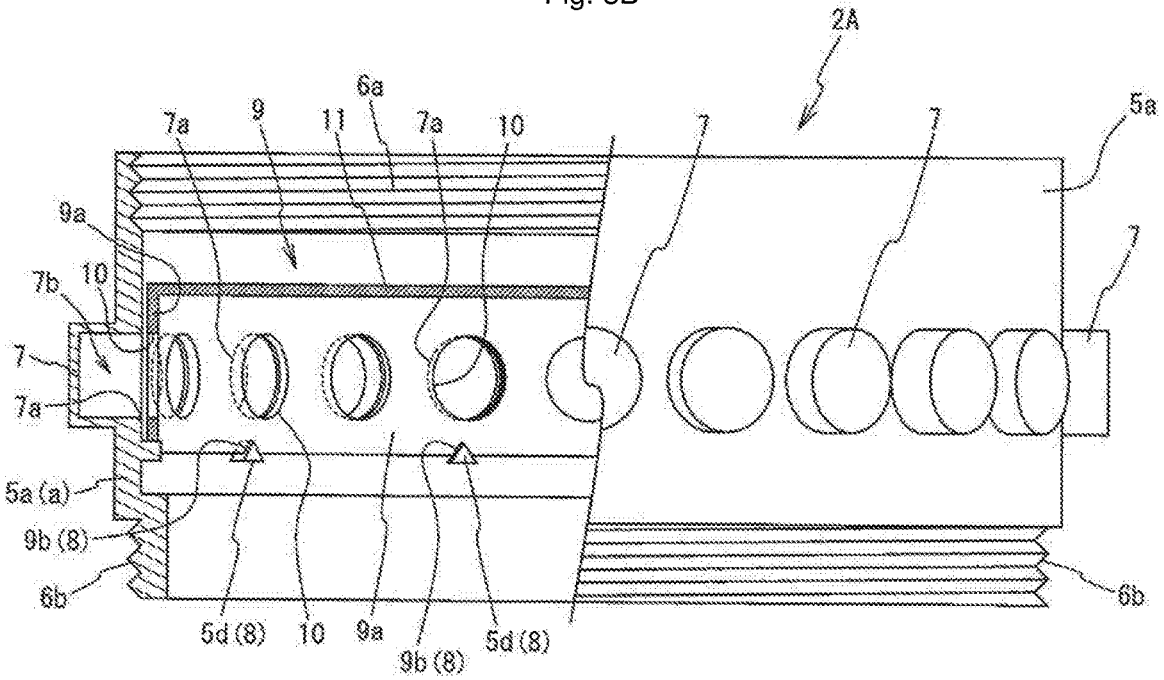
FIG. 3B is a cutaway side view of the first part with the support installed on the first part.

FIG. 1 is a side view of the mixing container and the spray container including the mixing container according to the first embodiment of the present invention. FIG. 2A is an exploded side view of the mixing container according to the first embodiment of the present invention. FIG. 2B is a perspective view of a support to be installed in the mixing container. FIG. 3A is a cutaway side view of a first part of the mixing container according to the first embodiment of the present invention. FIG. 3B is a cutaway side view of the first part with the support installed on the first part.

As shown in FIGS. 1 to 2B, a mixing container 2A according to the first embodiment of the present invention mainly includes a body 5 having an upper opening 5*c* to contain a dissolving agent (not shown), receiving chambers 7 on the peripheral surface of the body 5, a support 9 (refer to FIG. 2B) detachably installed within the body 5 in alignment with the receiving chambers 7, and a holding structure 8 (refer to FIGS. 2A and 2B) for detachably holding the support 9 within the body 5 in an area adjacent to the receiving chambers 7.

The holding structure 8 may include protrusions 5*d* from the inner peripheral surface of the body 5 toward the area for the installation of the support 9 as shown in FIG. 2A, and notches 9*b* (refer to FIG. 2B) cut in the support 9 partially conforming to the outer shape of the protrusion 5*d*.

As shown in FIGS. 1, 2A, and 3A, each receiving chamber 7 of the mixing container 2A according to the first embodiment is formed from a flexible material and protrudes outward from the inner peripheral surface of the body 5. The protrusion has a hollow 7*b* in which an individual storage portion 12*a* (storage pack 13) on a press-through pack (PTP) sheet (refer to a PTP sheet 12 in FIG. 4 described later) can be fitted from inside the body 5.

Although FIGS. 1, 2A, and 3A illustrate multiple receiving chambers 7 on the peripheral surface of the body 5, the mixing container 2A according to the first embodiment may include at least one receiving chamber 7 on the peripheral surface of the body 5.

The support 9 in the mixing container 2A according to the first embodiment includes a plate 9*a* for holding the edge of the PTP sheet (refer to the PTP sheet 12 in FIG. 4 described later) between the plate 9*a* and the inner peripheral surface of the body 5, and releasing holes 10 extending through the plate 9*a*. When the support 9 is installed within the body 5, each releasing hole 10 communicates with an inlet 7*a* of the corresponding receiving chamber 7 and allows the substance stored in the PTP sheet described later to be released into the body 5.

The mixing container 2A according to the first embodiment has a set of receiving chambers 7 arranged annularly around the peripheral surface of the body 5. Thus, for the mixing container 2A according to the first embodiment, the plate 9*a* of the support 9 has an annular shape conforming to the set of receiving chambers 7.

Although not shown, the mixing container 2A according to the first embodiment may have a set of receiving chambers 7 arranged simply on a part of the circumference of the body 5. In this case, the support 9 may also be arranged simply on an area corresponding to the area of the receiving chambers 7. However, the structure uses another mechanism to reliably hold the plate 9*a* on the inner peripheral surface of the body 5 although the plate 9*a* may has any shape other than an annular shape.

The mixing container 2A according to the first embodiment also has a fitting structure including the protrusions 5*d* (refer to FIG. 2A) on the body 5 and the notches 9*b* (refer to FIG. 2B) on the support 9 described above, as an example of the holding structure 8 for holding the support 9 within the body 5 in alignment with the receiving chambers 7.

In the mixing container 2A according to the first embodiment, the support 9 may be installed within the body 5 with the protrusions 5*d* on the body 5 fitted in the notches 9*b* on the plate 9*a* of the support 9. This allows the inlets 7*a* of the receiving chambers 7 to communicate with the releasing holes 10 in the support 9, as shown in FIG. 3B.

For molding, synthetic resins are particularly appropriate to the materials for the body 5, the receiving chambers 7, and the support 9 according to the first embodiment of the present invention. The materials for the body 5, the receiving chambers 7, and the support 9 may be determined as appropriate based on the physical and chemical properties of the dissolving agent to be contained in the body 5 and the substance to be stored in the PTP sheet (described later).

The body 5 and the receiving chambers 7 are to be formed from different materials. For example, the different materials may be molded into a single piece or separate pieces to be bonded together.

The PTP sheet for the mixing container 2A according to the first embodiment of the present invention will now be described with reference to FIGS. 4A to 4E.

Figure 4A:
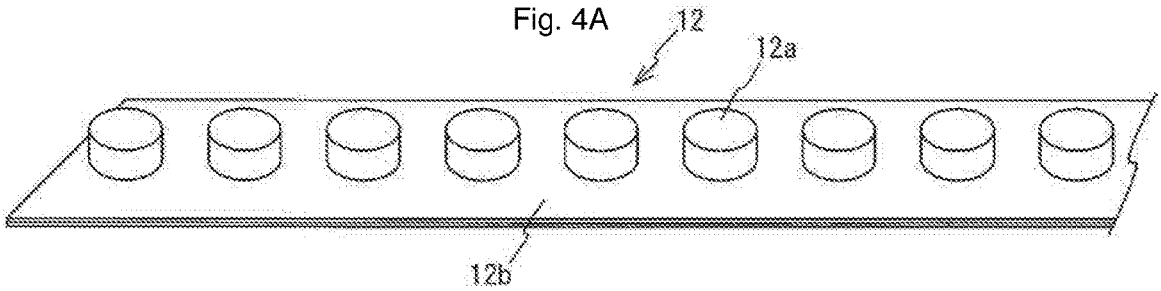
FIG. 4A is a perspective view of a press-through package (PTP) sheet for the mixing container according to the first embodiment of the present invention.
Figure 4B:
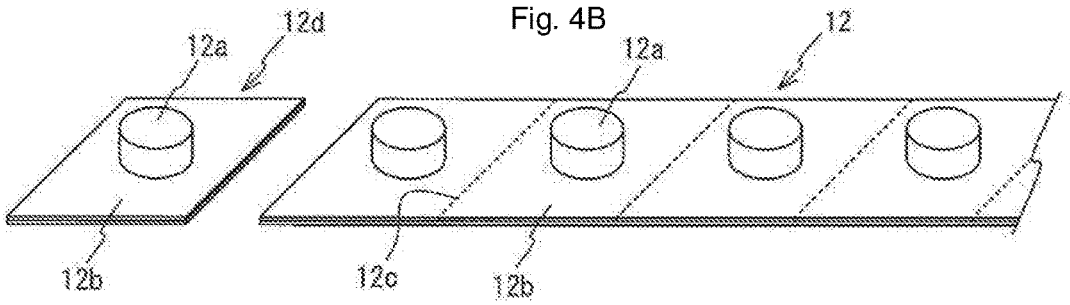
FIG. 4B is a perspective view of the PTP sheet in another form.
Figure 4C:
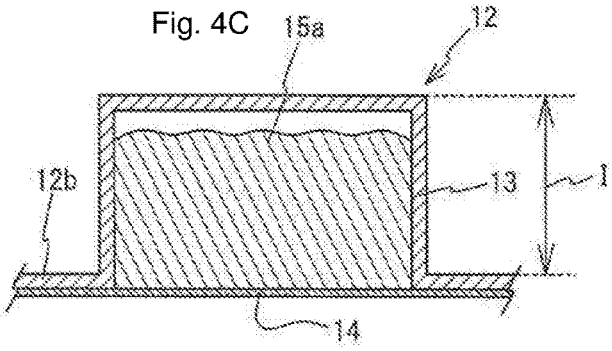
FIG. 4C is a cross-sectional view of the PTP sheet for the mixing container according to the first embodiment of the present invention.
Figure 4D:
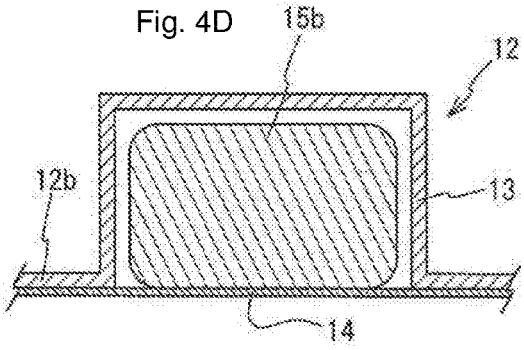
FIG. 4D is a cross-sectional view of the PTP sheet in another form.
Figure 4E:
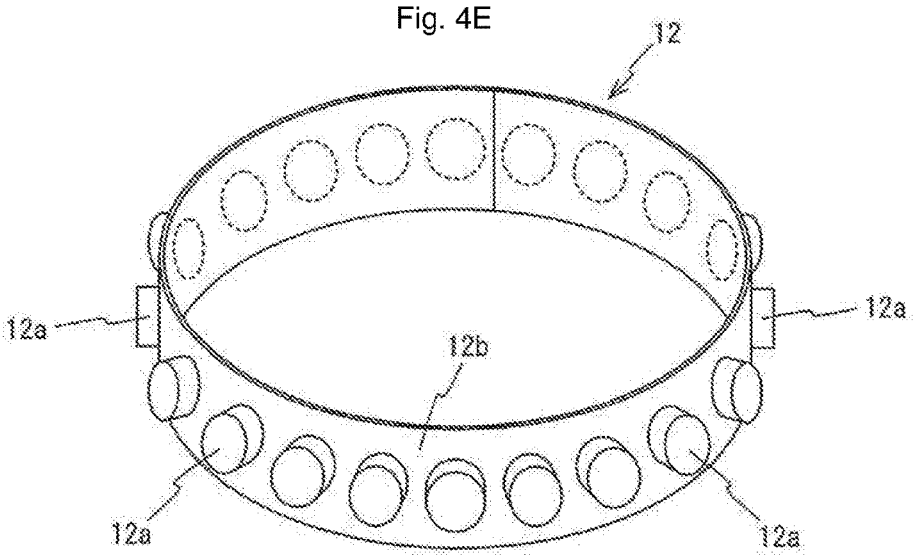
FIG. 4E is a perspective view of the PTP sheet in use for the mixing container according to the first embodiment of the present invention.

FIG. 4A is a perspective view of the PTP sheet for the mixing container according to the first embodiment of the present invention. FIG. 4B is a perspective view of the PTP sheet in another form. FIG. 4C is a cross-sectional view of the PTP sheet for the mixing container according to the first embodiment of the present invention. FIG. 4D is a cross-sectional view of the PTP sheet in another form. FIG. 4E is a perspective view of the PTP sheet in use for the mixing container according to the first embodiment of the present invention. The components that are also shown in FIGS. 1 to 3B are given the same reference numerals, and will not be described repeatedly.

As shown in FIGS. 4A, 4C, and 4D, the PTP sheet 12 has hollow storage packs 13 molded in a synthetic resin sheet, each of which stores a powder or liquid substance 15*a* or a solid substance 15*b*. The opening of the storage pack 13 is then covered with a film 14 to seal the stored substance 15*a* or 15*b* in the storage pack 13.

The mixing container 2A according to the present embodiment is a container for mixing a dissolving target substance (stored substance 15*a* or stored substance 15*b*) and a dissolving agent in the body 5. The container is not used for a dissolving target substance (stored substance 15*a* or stored substance 15*b*) insoluble in a dissolving agent or for a combination of a dissolving target substance and a dissolving agent that do not mix with each other.

Each storage pack 13 on the PTP sheet 12 forms an individual storage portion 12*a*. When the storage pack 13 is compressed from outside, the pressure inside the storage pack 13 increases to break the film 14, releasing the stored substance 15*a* or the stored substance 15*b* from the storage pack 13.

As shown in FIG. 4B, the PTP sheet 12 may have a separation line 12*c* between storage portions 12*a* for separating storage portions 12*a* into individual pieces. The use of individual pieces 12*d* separated from the PTP sheet 12 will be described later in a second embodiment.

In use, in the mixing container 2A according to the first embodiment of the present invention, the strip of the PTP sheet 12 shown in FIG. 4A is rolled into a ring with the opposite longitudinal ends connected to each other (refer to FIG. 4E).

In use, in the mixing container 2A according to the first embodiment, the hollows 7*b* of the individual receiving chambers 7 arranged on the middle part of the body 5 receive the individual storage portions 12*a* of the PTP sheet 12 shown in FIGS. 4A and 4E.

In the mixing container 2A according to the first embodiment of the present invention, the PTP sheet 12 shown in FIG. 4A to 4E is open to release the stored substance 15*a* or the stored substance 15*b* into the body 5. This procedure will now be described in detail with reference to FIGS. 2A to 5B.

Figure 5B:
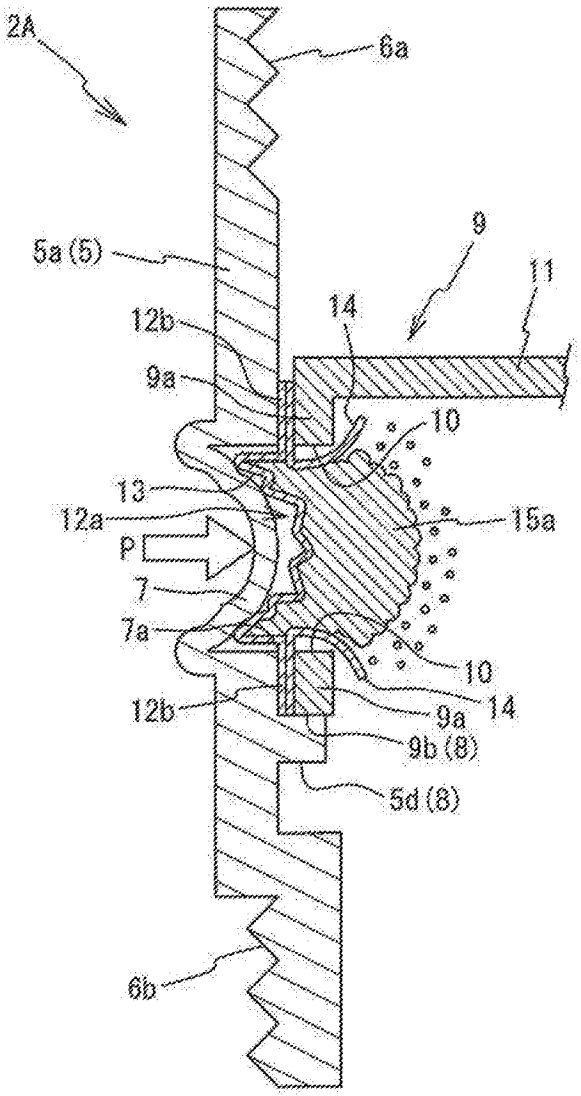
FIG. 5B is a partial cross-sectional view of the mixing container according to the first embodiment of the present invention, showing a stored substance being released from the PTP sheet into a body.
Figure 5A:
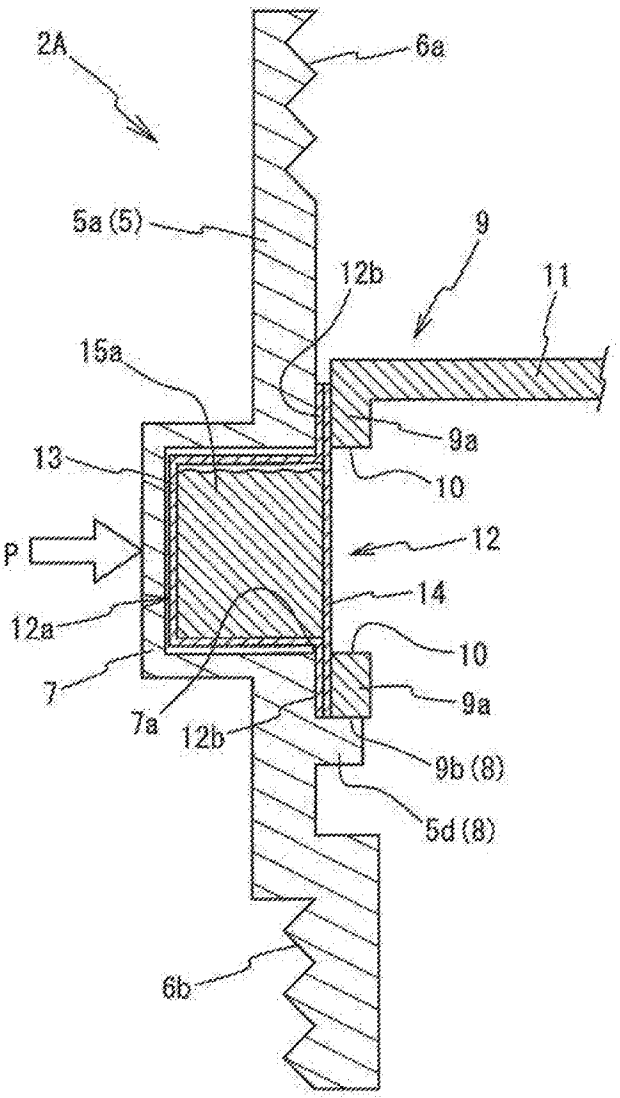
FIG. 5A is a partial cross-sectional view of the mixing container according to the first embodiment of the present invention with the PTP sheet and the support installed on the mixing container.

FIG. 5A is a partial cross-sectional view of the mixing container according to the first embodiment of the present invention with the PTP sheet and the support installed on the mixing container. FIG. 5B is a partial cross-sectional view of the mixing container according to the first embodiment of the present invention, showing the stored substance being released from the PTP sheet into the body. The components that are also shown in FIGS. 1 to 4E are given the same reference numerals, and will not be described repeatedly.

The procedure for installing the PTP sheet 12 in the mixing container 2A according to the first embodiment will be described first.

First, the storage portions 12*a* of the PTP sheet 12 shown in FIG. 4A are each fitted (not shown) in the corresponding hollow 7*b* of the receiving chamber 7 arranged on the body 5 shown in FIGS. 3A and 3B. The PTP sheet 12 with its storage portions 12*a* fitted in the corresponding hollows 7*b* of the body 5 has the annular outer shape shown in FIG. 4E.

The storage portions 12*a* of the PTP sheet 12 may be fitted not in all the receiving chambers 7 of the body 5, but in some receiving chambers 7. In this case, the PTP sheet 12 fitted in the set of the receiving chambers 7 does not have the annular outer shape shown in FIG. 4E.

Then, within the body 5, the support 9 shown in FIG. 2B is installed adjacent to the film 14 on the PTP sheet 12 fitted in the receiving chambers 7. In this installation, the protrusions 5*d* on the body 5 may be fitted in the notches 9*b* on the support 9 (refer back to FIG. 3B). This fitting allows the inlets 7*a* of the receiving chambers 7 to communicate with the releasing holes 10 in the support 9. FIG. 5A shows the state in which the PTP sheet 12 and the support 9 have been installed in the body 5.

As shown in FIG. 5A, in which the PTP sheet 12 is fitted in the receiving chambers 7 of the body 5, and the support 9 is further installed, the edge 12*b* of the PTP sheet 12 (refer back to FIG. 4A) are firmly held between the inner peripheral surface of the body 5 and the plate 9*a* of the support 9. In this state, the film 14 to be broken by the compression of the storage portions 12*a* of the PTP sheet 12 is adjacent to each releasing hole 10 in the support 9.

Then, as shown in FIG. 5A, when an external force P is applied from outside the body 5 to compress the receiving chamber 7, the storage pack 13 of the PTP sheet 12 is compressed within the receiving chamber 7 as shown in FIG. 5B. The resultant increase in the pressure within the storage pack 13 breaks the film 14, releasing the stored substance 15*a* from the PTP sheet 12 into the body 5 through the releasing hole 10 in the support 9.

This allows the dissolving agent (not shown) contained in the body 5 to mix with the stored substance 15*a* (or stored substance 15*b*) in the PTP sheet 12.

In this case, the individual storage portions 12*a* of the PTP sheet 12 hold the stored substance 15*a* (or stored substance 15*b*) of the same volume or weight, and the volume or weight of the dissolving agent contained in the body 5 may be adjusted in an intended manner to easily prepare a mixture with a specified concentration or percentage of the stored substance 15*a* (or stored substance 15*b*) to the dissolving agent.

In other cases in which the body 5 contains a fixed volume or weight of dissolving agent (not shown), the number of storage packs 13 to be open in the body 5 may also be changed in an intended manner to adjust the concentration or percentage of the stored substance 15*a* (or stored substance 15*b*) to the dissolving agent.

In the mixing container 2A according to the first embodiment of the present invention described above, a dissolving target substance (stored substance 15*a* or stored substance 15*b*) and a dissolving agent are mixed to prepare a mixture with a specified concentration or percentage. Simply changing the number of compressions of the receiving chambers 7 varies the concentration or percentage of the dissolving target substance (the stored substance 15*a* or the stored substance 15*b*). Thus, in preparing mixtures with different concentrations or percentages for each use, this structure eliminates an operation of measuring the stored substance 15*a* or the stored substance 15*b* and is thus particularly convenient.

In the mixing container 2A according to the first embodiment of the present invention, the stored substance 15*a* or the stored substance 15*b* in the PTP sheet 12 is directly fed into the body 5. Thus, the stored substance 15*a* or the stored substance 15*b* will not be accidentally spilled, unlike when the stored substance 15*a* (or stored substance 15*b*) is measured outside the body 5 and then poured into the body 5.

The mixing container 2A according to the first embodiment thus allows a mixture of a dissolving target substance (stored substance 15*a* or stored substance 15*b*) and a dissolving agent to be prepared quickly, accurately, and reliably.

Thus, in an example in which multiple liquid detergents with different dilution ratios are used for different purposes, the mixing container 2A according to the first embodiment allows the liquid detergents with various concentrations to be prepared easily with the mixing container 2A alone.

The mixing container 2A according to the first embodiment thus improves the convenience of the above mixture such as a detergent.

The support 9 for the mixing container 2A according to the first embodiment may include a reinforcement 11 (optional) across the hollow of the annular plate 9*a* as shown in FIG. 2B.

The reinforcement 11 included in the support 9 according to the first embodiment can appropriately prevent the plate 9*a* from deforming or being detached from the inner peripheral surface of the body 5 when a receiving chamber 7 is compressed from outside the body 5.

Although FIG. 2B illustrates a cross-shaped reinforcement 11 across the hollow of the short cylindrical (annular) plate 9*a*, the reinforcement 11 may be I-shaped or radial.

The reinforcement 11 may also be used as a handle for attaching and detaching the support 9 to and from the inner peripheral surface of the body 5. Thus, the support 9 according to the first embodiment with the reinforcement 11 can be handled more easily than the support 9 with no reinforcement 11.

The plate 9*a* may be rigid enough to be resistant to deformation when a receiving chamber 7 is compressed from outside the body 5. In this case, the reinforcement 11 may be eliminated.

The mixing container 2A according to the first embodiment of the present invention may include a spray nozzle 3*a* (optional) at the opening 5*c* of the body 5 as appropriate with a lid 4*a* as shown in FIG. 1.

The spray nozzle 3*a* allows the mixing container 2A according to the first embodiment to be used as a spray container 1A. More specifically, the mixing container 2A according to the first embodiment with the spray nozzle 3*a* can be used to directly spray a mixture prepared from the stored substance 15*a* or the stored substance 15*b* and a dissolving agent within the mixing container 2A.

The spray container 1A according to the first embodiment facilitates the handling of the mixture of the dissolving target substance (stored substance 15*a* or stored substance 15*b*) and the dissolving agent and also improves the convenience of the mixture.

The body 5 of the mixing container 2A according to the first embodiment of the present invention may also include a first part 5*a* (optional) having the multiple receiving chambers 7, second parts $5b_1$ and $5b_2$ (optional) other than the first part 5*a*, and connection sections 6*a* and 6*b* (optional) into which these parts are detachably screwed together as shown in FIGS. 1 to 2B.

Although FIGS. 1 to 2B illustrate the body 5 separated crosswise into three parts, the first part 5*a* and the second part $5b_2$ may be integrated without the connection section 6*b*.

In the body 5 of the mixing container 2A according to the first embodiment, the separable structure may allow an opening 19 other than the opening 5*c* to be located near the annularly arranged receiving chambers 7. The opening 19 of the body 5 allows the PTP sheet 12 to be easily attached to or detached from the receiving chambers 7, and the support 9 is also easily attached to or detached from the receiving chambers 7.

The body 5 of the mixing container 2A according to the first embodiment including such parts allows the PTP sheet 12 to be easily and smoothly attached to and detached from the receiving chambers 7, irrespective of the opening 5*c* with a far smaller diameter than the middle part of the body 5.

In addition, as shown in FIG. 1, the spray nozzle 3*a* can be easily installed at the opening 5*c* of the body 5 directly or indirectly, for example, with the lid 4*a*. In this case, the mixing container 2A according to the first embodiment may also be used as the spray container 1A. Thus, the structure improves the versatility and convenience of the mixing container 2A according to the first embodiment.

In the mixing container 2A according to the first embodiment and the spray container 1A including the mixing container 2A as shown in FIGS. 1 to 2B, the separable body 5 allows the inside of the individual parts (the first part 5*a*, and the second parts $5b_1$ and $5b_2$) of the body 5 to be washed easily and reliably.

This body 5, which is maintained in hygienic conditions, also keeps the hygienic conditions of a mixture prepared within the body 5.

Thus, the separable body 5 according to the first embodiment provides a spray container also serving as a mixing container that enables easy maintenance of hygienic conditions.

Although FIGS. 1 to 5B illustrate a single row of the receiving chambers 7 arranged circumferentially around the middle part of the body 5, multiple rows of receiving chambers 7 (not shown, optional) may be arranged circumferentially around the middle part of the body 5. In this case, the number of rows of the releasing holes 10 in the support 9 is to be changed depending on the number of rows of the receiving chambers 7.

For multiple rows of receiving chambers 7 arranged circumferentially around the middle part of the body 5, multiple strips of the PTP sheet 12 including a single row of the storage portions 12*a* as shown in FIG. 4A may be arranged, or a strip of PTP sheet (not shown) including multiple rows of storage portions 12*a* may be additionally prepared.

The above mixing container 2A according to the first embodiment reduces the frequency of replacement of the PTP sheet 12 in the body 5.

This further improves the convenience of the mixing container 2A and the spray container 1A according to the first embodiment.

Second Embodiment

A mixing container and a spray container including the mixing container according to a second embodiment of the present invention will now be described with reference to FIGS. 6 to 9.

Figure 6:
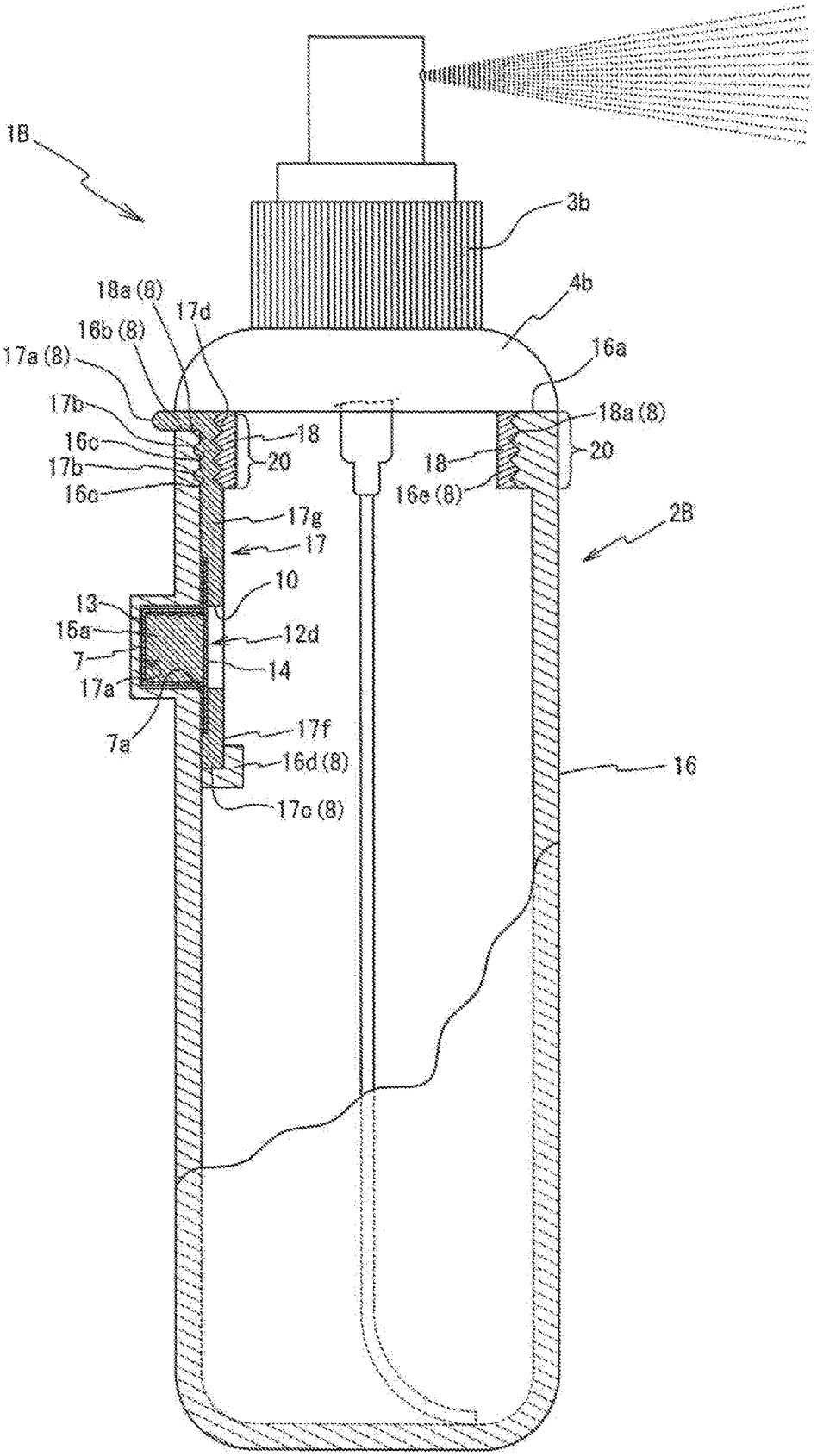
FIG. 6 is a cutaway side view of a mixing container and a spray container including the mixing container according to a second embodiment of the present invention with a body partially cut away.
Figure 7A:
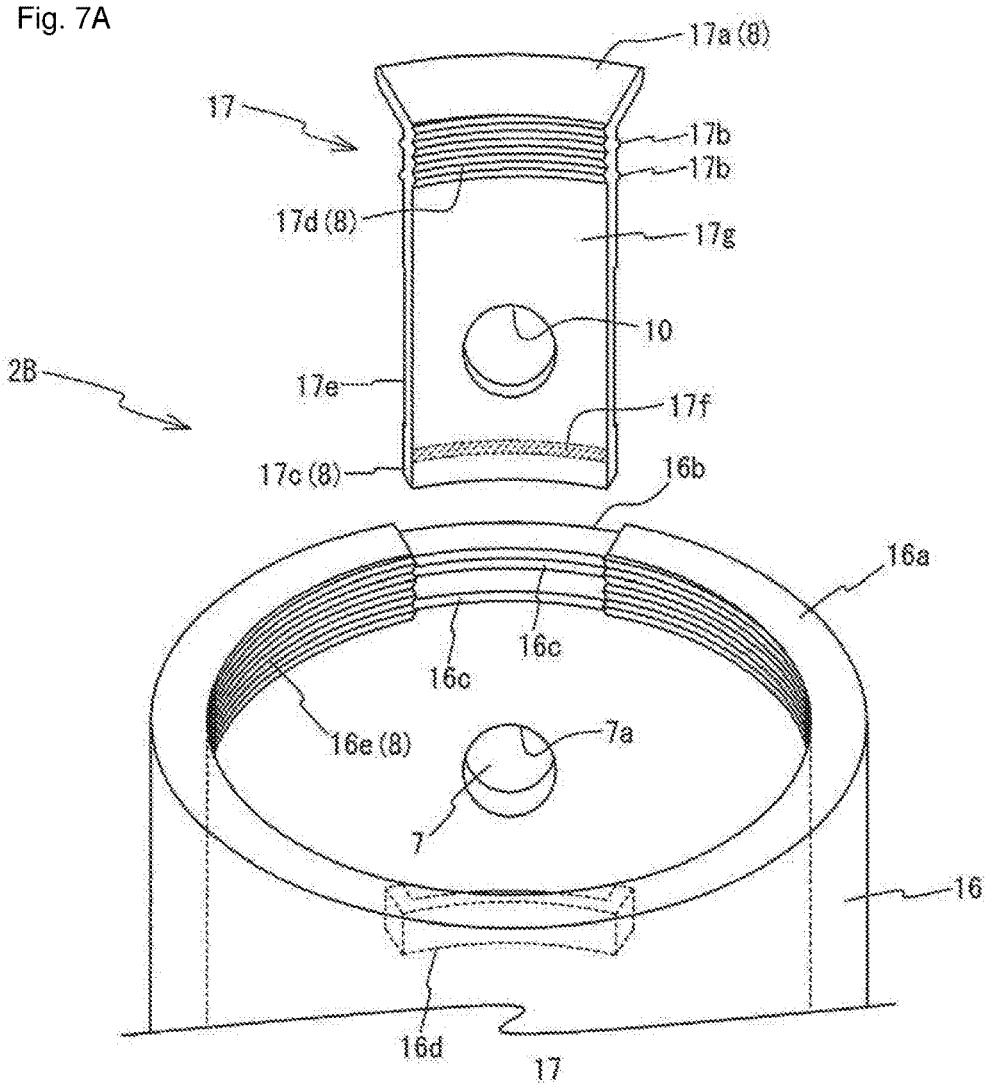
FIG. 7A is a partial perspective view of the mixing container according to the second embodiment of the present invention with a support separated from the body including a receiving chamber.
Figure 7B:
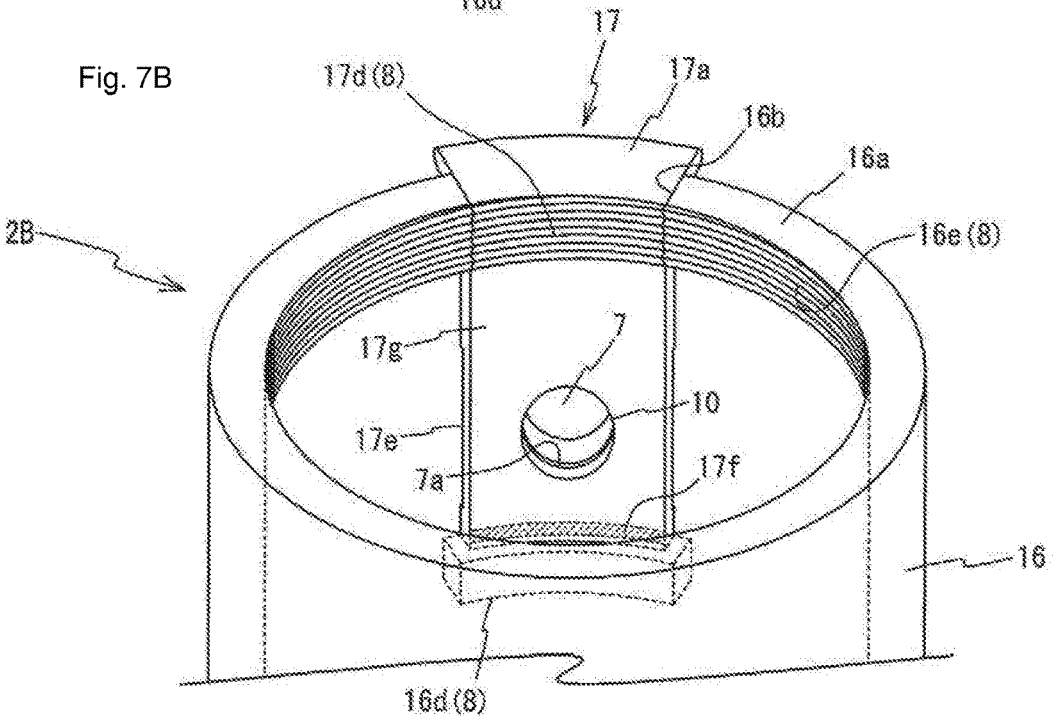
FIG. 7B is a partial perspective view of the mixing container according to the second embodiment of the present invention with the support installed in the body including the receiving chamber.

FIG. 6 is a cutaway side view of the mixing container and the spray container including the mixing container according to the second embodiment of the present invention with a body partially cut away. FIG. 7A is a partial perspective view of the mixing container according to the second embodiment of the present invention with a support separated from the body including a receiving chamber. FIG. 7B is a partial perspective view of the mixing container according to the second embodiment of the present invention with the support installed in the body including the receiving chamber. The components that are also shown in FIGS. 1 to 5B are given the same reference numerals, and will not be described repeatedly. FIG. 6 is a cross-sectional view of the body with a piece of a PTP sheet in the receiving chamber, whereas FIGS. 7A and 7B show the body with no PTP sheet in the receiving chamber.

The mixing container 2A according to the first embodiment, which has the multiple receiving chambers 7 arranged around the middle part of the body 5, may be appropriate for the body 5 that is relatively large. In contrast, the mixing container according to the second embodiment has a structure appropriate for a relatively small body, and the mixing container is appropriate to carry.

As shown in FIGS. 6 to 7B, a mixing container 2B according to the second embodiment of the present invention includes a body 16 (corresponding to the body 5 according to the first embodiment) having an upper opening 16*a* to contain a dissolving agent (not shown), a receiving chamber 7 integral with the peripheral surface of the body 16, and a support 17 (corresponding to the support 9 according to the first embodiment) including a plate 17*g* detachably installed within the body 16 in an area adjacent to the receiving chamber 7.

Figure 9:
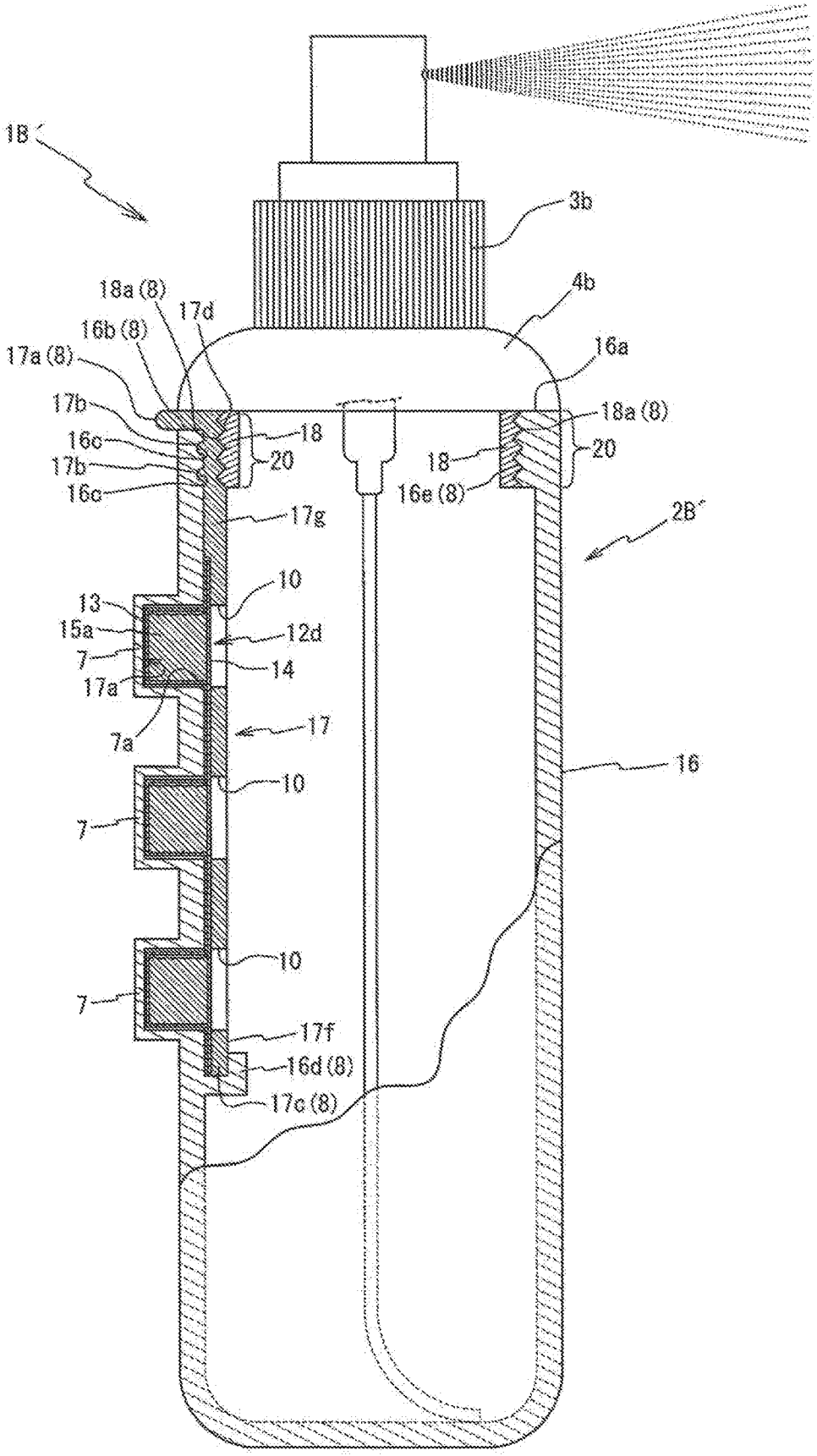
FIG. 9 is a cutaway side view of a mixing container and a spray container including the mixing container according to a modification of the second embodiment of the present invention with a body partially cut away.

Although FIGS. 6 to 7B illustrate a single receiving chamber 7 in the peripheral surface of the body 16, the body 16 may include multiple receiving chambers 7 as shown in FIG. 9.

The mixing container 2B according to the second embodiment also includes a lid 4*b* attached to the opening 16*a* of the body 16 and having a first thread 18*a* on the outer surface of its vertically lower end portion 18.

As shown in FIGS. 6 and 7A, the body 16 of the mixing container 2B according to the second embodiment also includes a fitting recess 16*b* at the opening 16*a* of the body 16 and fitted on the vertically upper end of the support 17, a fitting receiving portion 16*d* on the inner peripheral surface of the body 16 and receiving the support 17 at its lower end 17*c*, and a second thread 16*e* on the inner peripheral surface of the body 16 and adjacent to the opening 16*a*.

As shown in FIGS. 6 and 7A, the support 17 for the mixing container 2B according to the second embodiment additionally includes a third thread 17*d* and a flexible portion 17*f*. When the support 17 is fitted with its tab 17*a* in the fitting recess 16*b* on the body 16, the third thread 17*d* circumferentially connects with the second thread 16*e* at the opening 16*a* of the body 16 to serve as an integrated thread. The flexible portion 17*f* is adjacent to the insertion portion of the lower end 17*c* of the support 17 to be received in the fitting receiving portion 16*d* of the body 16 and allows the support 17 to be tilted toward the center of the body 16.

As shown in FIG. 7B, in the mixing container 2B according to the second embodiment described above, the lower end 17*c* of the support 17 is fitted and fixed in the fitting receiving portion 16*d* of the body 16, and the tab 17*a* of the support 17 is fitted in the fitting recess 16*b* on the body 16 (refer to FIG. 7B). In this state, the lower end portion 18 of the lid 4*b* (refer to FIG. 6) is screwed into the opening 16*a* of the body 16. In this manner, the support 17 can be held at an intended position on the inner peripheral surface of the body 16 as shown in FIG. 6.

Thus, the mixing container 2B according to the second embodiment has a holding structure 8 for detachably holding the support 17 within the body 16 in an area adjacent to the receiving chamber 7. The holding structure 8 includes a fitting structure including the lower end 17*c* of the support 17 and the fitting receiving portion 16*d* of the body 16, a fitting structure including the tab 17*a* of the support 17 and the fitting recess 16*b* on the body 16, and a connection section 20 (second connection section, refer to FIG. 6) including the continuous thread of the second thread 16*e* and the third thread 17*d* and the first thread 18*a* on the lid 4*b*.

As shown in FIG. 6 and FIG. 7B, when the support 17 is held on the inner peripheral surface of the body 16 in the mixing container 2B according to the second embodiment, an inlet 7*a* of the receiving chamber 7 in the body 16 communicates with a releasing hole 10 in the support 17 in the same manner as in the mixing container 2A according to the first embodiment.

The procedure for installing a PTP sheet 12 into the mixing container 2B according to the second embodiment will now be described in detail with reference to FIGS. 8A to 8C.

FIGS. 8A to 8C are partial cross-sectional views of the mixing container according to the second embodiment of the present invention, describing the procedure for installing the PTP sheet into the receiving chamber. The components that are also shown in FIGS. 1 to FIG. 7B are given the same reference numerals, and will not be described repeatedly.

As shown in FIGS. 6 to 7B, for the mixing container 2B according to the second embodiment having the single receiving chamber 7 in the middle part of the body 16, a piece 12*d* may be separated from the PTP sheet 12 shown in FIG. 4B and used. The piece 12*d* shown in FIG. 4B may be replaced with each of the pieces obtained by separating the PTP sheet 12 shown in FIG. 4A.

To install the piece 12*d* of the PTP sheet 12 shown in FIG. 4B into the mixing container 2B according to the second embodiment, the piece 12*d* of the PTP sheet 12 is prepared first and, as shown in FIG. 8A, the lid 4*b* (and the lower end portion 18 integral with the lid 4*b*) is removed from the mixing container 2B according to the second embodiment.

Then, with the lower end 17*c* of the support 17 fitted in the fitting receiving portion 16*d* of the body 16, the tab 17*a* of the support 17 is tilted toward the center of the body 16 (in the direction of arrow A in FIG. 8B). During tilting, the flexible portion 17*f* adjacent to the lower end 17*c* of the support 17 functions as hinges to tilt the support 17 (refer to FIG. 8B).

In this state, the inlet 7*a* of the receiving chamber 7 is open as shown in FIG. 8B. The piece 12*d* of the PTP sheet 12 is fitted in the inlet 7*a*, and then the support 17 tilted toward the center of the body 16 is returned to the initial position. In other words, the tab 17*a* of the support 17 is reversed in the direction of arrow B in FIG. 7B.

In this procedure, as shown in FIG. 8C, the piece 12*d* of the PTP sheet 12 is placed between the receiving chamber 7 and the support 17, and the inlet 7*a* of the receiving chamber 7 communicates with the releasing hole 10 in the support 17, as viewed in the cross section of the body 16. In this state, the film 14 on the PTP sheet 12 is exposed through the releasing hole 10 in the support 17.

Then, the connection section 20 of the lid 4*b* is screwed into the opening 16*a* of the body 16. This fastening causes the support 17 to firmly fix the piece 12*d* of the PTP sheet 12 as shown in FIG. 8C, enabling the release of the stored substance 15*a* (or stored substance 15*b*) from the storage pack 13.

For the mixing container 2B according to the second embodiment described above, the procedure for releasing the stored substance 15*a* (or stored substance 15*b*) from the PTP sheet 12 into the body 16 is the same as for the mixing container 2A according to the first embodiment already described with reference to FIG. 5, and will not be described in detail repeatedly.

For the mixing container 2B according to the second embodiment, the tab 17*a* of the support 17 is tilted toward the center of the body 16 with respect to the flexible portion 17*f*. In a first case, the entire support 17 may be formed from a flexible material. In a second case, the flexible portion 17*f* of the support 17 may be formed from a flexible material with the other parts formed from a sufficiently stiff material.

In the first case, while the flexible portion 17*f* has moderate flexibility, the support 17 is to have stiffness sufficiently resistant to deformation when the receiving chamber 7 is compressed to release the stored substance 15*a* (or stored substance 15*b*) from the PTP sheet 12.

In the second case, the flexible portion 17*f* may be thinner than the other parts of the support 17 to be more flexible.

In addition, as shown in FIGS. 7A and 7B, the support 17 for the mixing container 2B according to the second embodiment is curved in its horizontal section (refer to FIGS. 7A and 7B). To conform to the curve, the flexible portion 17*f* of the support 17 in the second case is to be vertically longer. This flexible portion 17*f* allows the support 17 to be tilted smoothly irrespective of the curved horizontal section of the support 17.

In some embodiments, the part of the body 16 that receives the support 17 (the part of the body 16 in contact with the support 17) may be flattened, and thus the support 17 installed on this part may also be flattened (not shown). However, the part of the support 17 at the opening 16*a* of the body 16 is to have a shape conforming to the opening 16*a*. This shape allows the support 17 to be smoothly tilted irrespective of the vertical length of the flexible portion 17*f* of the support 17.

As shown in FIGS. 6 to 8C, the body 16 in the mixing container 2B according to the second embodiment may have at least one fitting groove 16*c* (optional) on its inner peripheral surface in contact with the support 17. The support 17 may have a fitting ridge 17*b* (optional) fitted in the fitting groove 16*c*.

In this case, the fitting recess 16*b* on the body 16 and the tab 17*a* of the support 17 form the fitting structure, as well as the fitting groove 16*c* and the fitting ridge 17*b* form a fitting structure. Such fitting structures allow the support 17 to be installed at the intended position on the inner peripheral surface of the body 16 with higher accuracy.

For the support 17 that is entirely formed from a flexible material, the fitting structure including the fitting groove 16*c* and the fitting ridge 17*b* may also function as a gasket. When the lid 4*b* is screwed into the opening 16*a* of the body 16 containing liquid, the fitting structure appropriately prevents the dissolving agent from leaking through the contact between the body 16 and the support 17.

When the body 16 is carried while containing a mixture of the dissolving agent and the stored substance 15*a* or the stored substance 15*b* from the PTP sheet 12, this structure conveniently seals the mixture in a watertight manner.

As shown in FIG. 6, the mixing container 2B according to the second embodiment may also include a spray nozzle 3*b* (optional) on the lid 4*b*.

The spray nozzle 3*b* allows the mixing container 2B according to the second embodiment to be used as a spray container 1B, further improving the convenience and versatility of the mixing container 2B.

A modification of the mixing container 2B according to the second embodiment of the present invention and the spray container 1B including the mixing container 2B will now be described with reference to FIG. 9.

FIG. 9 is a cutaway side view of a mixing container and a spray container including the mixing container according to the modification of the second embodiment of the present invention with a body partially cut away. The components that are also shown in FIGS. 1 to 8C are given the same reference numerals, and will not be described repeatedly.

Although FIGS. 6 to 8C illustrate a single receiving chamber 7 in the middle part of the body 16, the body 16 may include a few receiving chambers 7 on its middle part as shown in FIG. 9. A mixing container 2B' and a spray container 1B' according to the modification of the second embodiment may include a strip of PTP sheet 12 as shown in FIG. 4A replacing the pieces 12*d* of the PTP sheet 12 shown in FIG. 4B.

The above mixing container 2A and the spray container 1A according to the first embodiment include the multiple receiving chambers 7 arranged circumferentially around the middle part of the body 5. In contrast, the mixing container 2B' and the spray container 1B' shown in FIG. 9 according to the modification of the second embodiment have a PTP sheet 12 installed in parallel with the central axis of the body 16.

Compared with the mixing container 2B and the spray container 1B shown in FIGS. 6 to 8C according to the second embodiment, the mixing container 2B' and the spray container 1B' shown in FIG. 9 according to the modification of the second embodiment reduces the frequency of replacement of the PTP sheet 12 from the receiving chamber 7 and allows a larger amount of mixture to be prepared at a time with a high concentration or percentage of a dissolving target substance (stored substance 15*a* or stored substance 15*b*).

The effects of the mixing containers 2A to 2B' according to the first and second embodiments of the present invention will now be described.

In the mixing containers 2A to 2B' according to the first and second embodiments, the use of the PTP sheet 12 eliminates an operation of measuring a dissolving target substance (e.g., stored substance 15*a* or stored substance 15*b*) when the dissolving target substance is mixed with a dissolving agent to prepare a mixture with a specified concentration. This greatly facilitates the preparation of different mixtures with various concentrations.

The mixing containers 2A to 2B' according to the first and second embodiments further eliminate an operation of measuring a dissolving target substance (stored substance 15*a*) and a dissolving agent (not shown) outside the body 5 or 16 and pouring them into the body 5 or 16, unlike cases without the PTP sheet 12. This prevents mismeasurement and spill of a dissolving target substance (stored substance 15*a*) and a dissolving agent being mixed, thus appropriately avoiding an unspecified concentration or percentage of the dissolving target substance (stored substance 15*a*) in the mixture.

Thus, the mixing containers 2A to 2B' according to the first and second embodiments allow the user to easily prepare a mixture having an accurate concentration or percentage without taking particular attention, thus improving the convenience of the prepared mixture.

For the mixing container 2A or 2B' according to the embodiments with the body 5 or 16 containing a fixed volume of dissolving agent, the number of storage portions 12*a* to be open by compressing the receiving chambers 7 may be simply changed in an intended manner to vary the concentration or percentage of the stored substance 15*a* or the stored substance 15*b* in the mixture.

For the mixing container 2B, which has the single storage portion 12*a* of the PTP sheet 12 installed in the body 16, the volume or weight of the dissolving agent contained in the body 16 may be mainly changed to adjust the concentration or percentage of the stored substance 15*a* or the stored substance 15*b* in the mixture.

However, the body 16 in the mixing container 2B according to the second embodiment may have a smaller volume than in the above mixing container 2A according to the first embodiment, additionally providing high portability to the mixing container.

In some embodiments, the body 5 or 16 of the mixing containers 2A to 2B' according to the first and second embodiments of the present invention may also be formed from a light transmissive material (optional) that allows the uppermost level of the dissolving agent to be visually observed from outside. Additionally, the body 5 or 16 may be graduated (optional) to indicate the amount of the contained dissolving agent.

In this case, a specified amount of dissolving agent may not be measured outside the body 5 or 16 before poured into the body 5 or 16.

These mixing containers 2A to 2B' according to the first and second embodiments allow a mixture to be prepared still more easily than the body 5 or 16 that is not graduated.

In the mixing containers 2A to 2B' according to the first and second embodiments, the receiving chambers 7 on the body 5 or 16 and the storage packs 13 of the PTP sheet 12 may also be formed from light transmissive materials (optional).

This enables visual determination from outside the body 5 or 16 as to whether each storage pack 13 still contains the stored substance 15*a* or the stored substance 15*b*.

This structure eliminates the trouble of searching for a receiving chamber 7 containing an unopen storage pack 13 in using the mixing containers 2A to 2B' according to the first and second embodiments, further allowing a mixture to be prepared more easily.

In addition, the mixing containers 2A to 2B' according to the first and second embodiments allow the body 5 or 16 to be reused by simply replacing the PTP sheet 12 installed in the body 5 or 16.

Thus, the mixing containers 2A to 2B' according to the first and second embodiments also allow a mixture with an accurate concentration or percentage to be prepared easily and economically.

Each storage portion 12*a* of the PTP sheet 12 for the mixing containers 2A to 2B' according to the first and second embodiments of the present invention may have substantially the same shape and size as the hollow 7*b* of each receiving chamber 7 in the body 5.

For a storage portion 12*a* of the PTP sheet 12 excessively smaller than the hollow 7*b* of the receiving chamber 7, when the receiving chamber 7 is compressed from outside the body 5 or 16, the pressing force may be insufficiently transferred to the storage pack 13, failing to open the storage pack 13.

Although the receiving chamber 7 for the mixing containers 2A to 2B' according to the first and second embodiments is circular in a plan view, the receiving chamber 7 may be noncircular. For a noncircular receiving chamber 7, the storage portion 12*a* of the PTP sheet 12 received in the hollow 7*b* of the receiving chamber 7 is to substantially correspond to the receiving chamber 7 in shape and size.

For a receiving chamber 7 having a part acute in a plan view, when the storage pack 13 of the PTP sheet 12 is open, the stored substance 15*a* may remain in the storage pack 13 as unintended.

The receiving chamber 7 may be smooth in a plan view, and optimally be circular.

Third Embodiment

A mixing container according to a third embodiment will now be described in detail with reference to FIGS. 10A to 12.

The mixing container according to the third embodiment is a modification of the mixing containers 2A to 2B' according to the first and second embodiments, with an improved receiving chamber 7.

A receiving chamber according to a first modification will be described first with reference to FIGS. 10A to 11B.

Figure 10B:
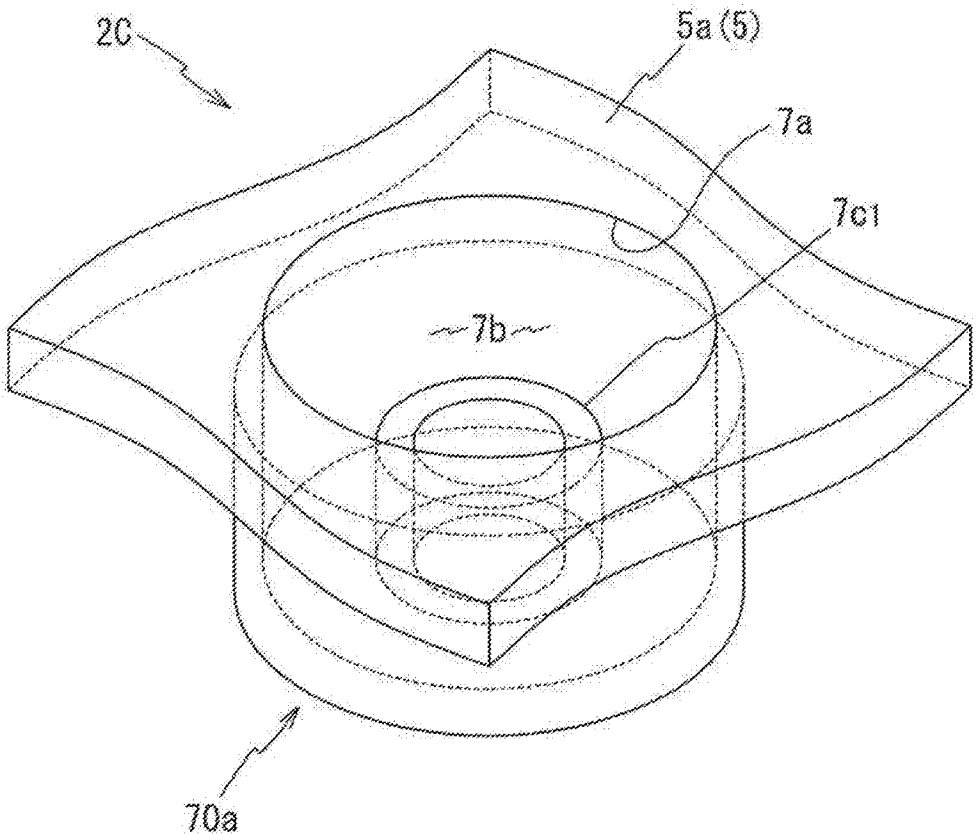
FIG. 10B is an enlarged partial perspective view of a receiving chamber in the mixing container.
Figure 10A:
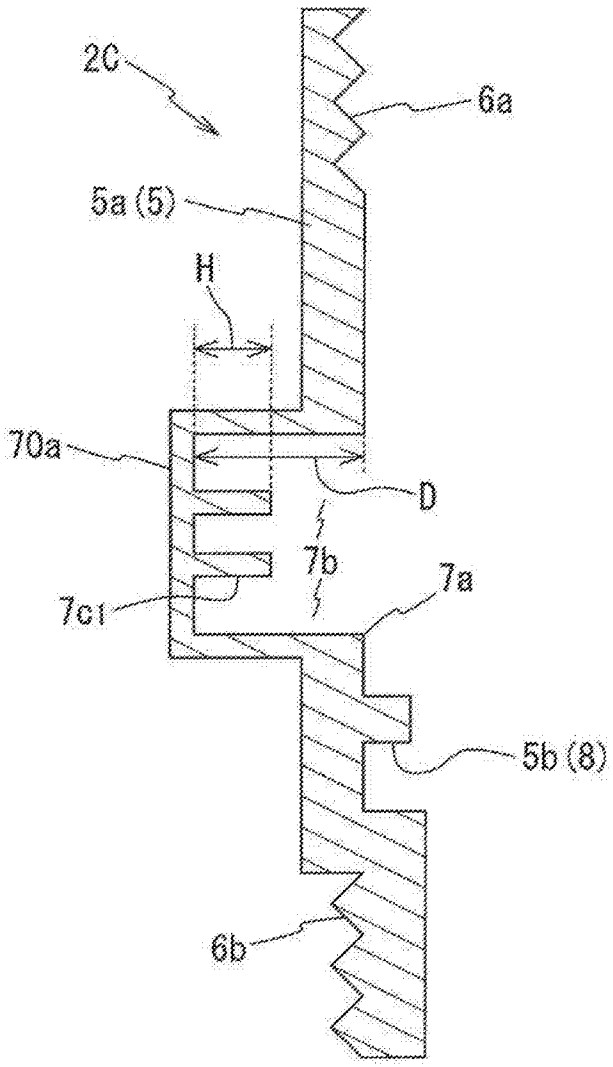
FIG. 10A is a partial cross-sectional view of a mixing container according to a third embodiment of the present invention.
Figure 11B:
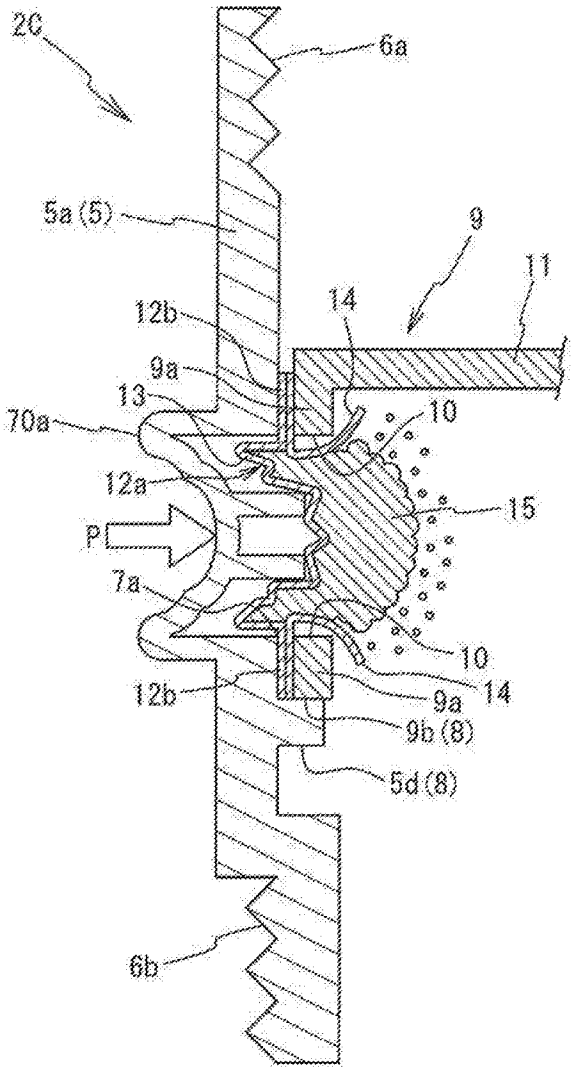
FIG. 11B is a partial cross-sectional view of the mixing container according to the third embodiment of the present invention, showing a stored substance being released from the PTP sheet into a body.
Figure 11A:
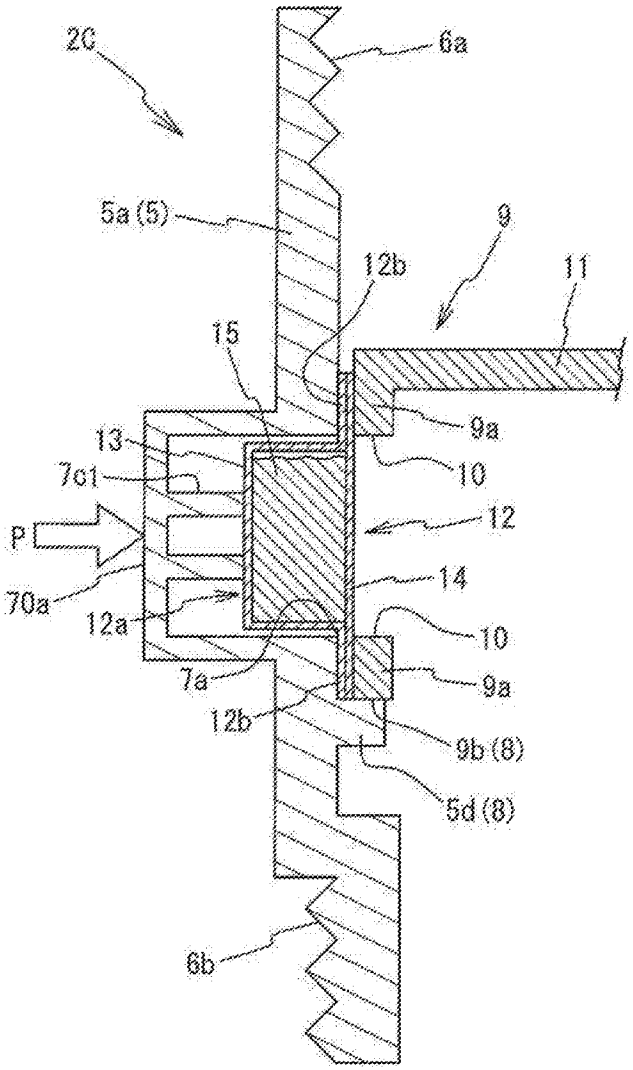
FIG. 11A is a partial cross-sectional view of the mixing container according to the third embodiment of the present invention with a PTP sheet and a support installed on the mixing container.

FIG. 10A is a partial cross-sectional view of the mixing container according to the third embodiment of the present invention. FIG. 10B is an enlarged partial perspective view of the receiving chamber in the mixing container. FIG. 11A is a partial cross-sectional view of the mixing container according to the third embodiment of the present invention with a PTP sheet and a support installed on the mixing container. FIG. 11B is a partial cross-sectional view of the mixing container, showing a stored substance being released from the PTP sheet into a body. The components that are also shown in FIGS. 1 to 9 are given the same reference numerals, and will not be described repeatedly.

As shown in FIGS. 10A and 10B, a receiving chamber 70*a* according to the first modification includes at least one protrusion $7c_1$ extending from the inner surface defining the hollow 7*b* in the direction of pressing the receiving chamber 70*a* with a finger (refer to arrow P in FIG. 11 described later).

The protrusion $7c_1$ in the hollow 7*b* of the receiving chamber 70*a* may be cylindrical as shown in FIGS. 10A and 10B or columnar (not shown).

The procedure for releasing the stored substance 15 from the PTP sheet 12 into the body 5 in a mixing container 2C according to the third embodiment is substantially the same as the procedure in the spray container 1A according to the above first embodiment. The stored substance 15 in the PTP sheet 12 may be powder or liquid. In the third embodiment and a fourth embodiment described later, the stored substances will be collectively referred to as the stored substance 15.

More specifically, the storage portion 12*a* (storage pack 13) of the PTP sheet 12 is first placed in the hollow 7*b* through the inlet 7*a* of the receiving chamber 70*a*, and the support 9 is installed adjacent to the film 14 on the PTP sheet 12. This completes the installation of the PTP sheet 12 in the body 5 (refer to FIG. 11A).

Then, the receiving chamber 70*a* in the state shown in FIG. 11A may be pushed toward the hollow of the body 5 to compress the receiving chamber 70*a* from outside. In other words, the receiving chamber 70*a* containing the PTP sheet 12 may be pushed in the direction of arrow P in FIG. 11A.

This action causes the protrusion $7c_1$ in the hollow 7*b* of the receiving chamber 70*a* to compress the storage pack 13, breaking the film 14. The stored substance 15 in the storage pack 13 is released into the hollow of the body 5 (refer to FIG. 11B).

The receiving chamber 7 for the above spray containers 1A to 1B' according to the first and second embodiments does not include the protrusion $7c_1$, and the height difference of the receiving chamber 7 from the outer peripheral surface of the body 5 is smaller than the height difference of the receiving chamber 70*a* according to the third embodiment. Thus, to reliably compress the storage pack 13 received in the hollow 7*b* in the above spray containers 1A to 1B' according to the first and second embodiments, the receiving chamber 7 is to be pushed hard inward from the body 5. Such a hard push is achieved by enough finger strength.

When a person with low finger strength pushes the receiving chamber 7 in the above spray containers 1A to 1B' according to the first and second embodiments, an insufficient push on the receiving chamber 7 may fail to compress the storage pack 13 or only slightly deform the storage pack 13, leaving the stored substance 15 partially within the storage pack 13.

In contrast, in the mixing container 2C according to the third embodiment, the receiving chamber 70*a*, which has the protrusion $7c_1$ in the hollow 7*b*, can be higher than the receiving chamber 7 from the outer peripheral surface of the body 5 by the height H of the protrusion $7c_1$ (refer to FIG. 10A). In the mixing container 2C according to the third embodiment, a press on the receiving chamber 70*a* can displace the receiving chamber 70*a* more than in the above spray containers 1A to 1B' according to the first and second embodiments.

In addition, in the mixing container 2C according to the third embodiment, when the receiving chamber 70*a*, which has the protrusion $7c_1$ in its hollow 7*b*, is pushed inward from outside the body 5 (refer to arrow P in FIGS. 11A and 11B), the protrusion $7c_1$ can indirectly compress the storage pack 13 of the PTP sheet 12. More specifically, to compress the storage pack 13, the mixing container 2C according to the third embodiment allows the storage pack 13 to be pushed toward the center of the body 5 harder than for the receiving chamber 70*a* that has no protrusion $7c_1$.

With the receiving chamber 70*a* according to the first modification, the stored substance 15 contained in the PTP sheet 12 can be released into the body 5 more reliably than in the spray containers 1A to 1B' according to the first and second embodiments.

The mixing container 2C according to the third embodiment allows even a person with low finger strength to easily and reliably release the stored substance 15 from the PTP sheet 12 into the body 5. Thus, the mixing container 2C according to the third embodiment has further improved convenience.

To reliably place the storage pack 13 of the PTP sheet 12 into the hollow 7*b* of the receiving chamber 70*a* according to the first modification, the value obtained by subtracting the height H of the protrusion $7c_1$ from the depth D of the hollow 7*b* in FIG. 10A (D-H) is to be equal to or greater than the height difference I of the storage pack 13 of the PTP sheet 12 (refer back to FIG. 4C).

When the storage pack 13 of the PTP sheet 12 is placed in the hollow 7*b* of the receiving chamber 70*a* according to the first modification, the tip of the protrusion $7c_1$ may be spaced from the storage pack 13, although the gap may be minimized. As the gap widens between the tip of the protrusion $7c_1$ and the storage pack 13, the tip of the protrusion $7c_1$ becomes less likely to come into contact with the storage pack 13 when the receiving chamber 70*a* is pushed into the hollow of the body 5. Consequently, the protrusion $7c_1$ may fail to appropriately compress the storage pack 13.

A receiving chamber according to a second modification of the third embodiment will now be described with reference to FIG. 12.

Figure 12:
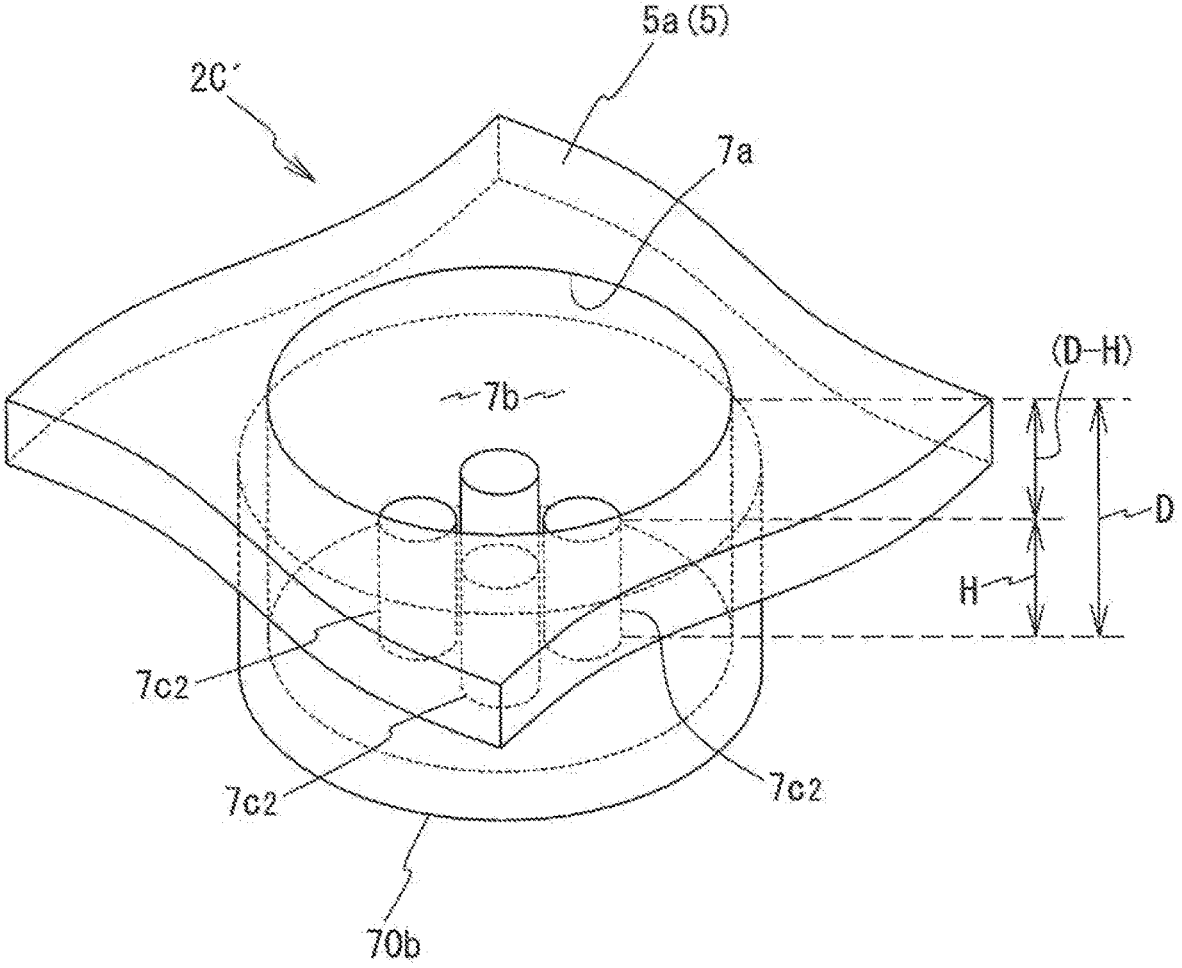
FIG. 12 is an enlarged partial perspective view of a receiving chamber according to a second modification of the third embodiment of the present invention.

FIG. 12 is an enlarged partial perspective view of the receiving chamber according to the second modification of the third embodiment of the present invention. The components that are also shown in FIGS. 1 to 11B are given the same reference numerals, and will not be described repeatedly.

Although FIGS. 10A to 11B illustrate a single hollow protrusion $7c_1$ included in the hollow 7*b* of the receiving chamber 70*a* according to the first modification, the receiving chamber 70*a* may include two or more protrusions.

More specifically, as shown in FIG. 12, a receiving chamber 70*b* according to the second modification of the third embodiment may include two or more columnar protrusions $7c_2$ in its hollow 7*b*. In this case, when the receiving chamber 70*b* is pushed inward from outside the body 5, the tips of the protrusions $7c_2$ press the storage pack 13 of the PTP sheet 12 while expanding radially (not shown).

The tips of the protrusions $7c_2$ can press a larger area of the protruded surface of the storage pack 13 of the PTP sheet 12. The press efficiently forces the stored substance 15 at the rim of the storage pack 13 into the hollow of the body 5.

The mixing containers 2C and 2C' according to the third embodiment, although not shown, may be used as a spray container with a spray nozzle installed directly or indirectly on the body 5.

Fourth Embodiment

Finally, a PTP sheet according to a fourth embodiment will now be described with reference to FIGS. 13A to 14B.

Figure 13A:
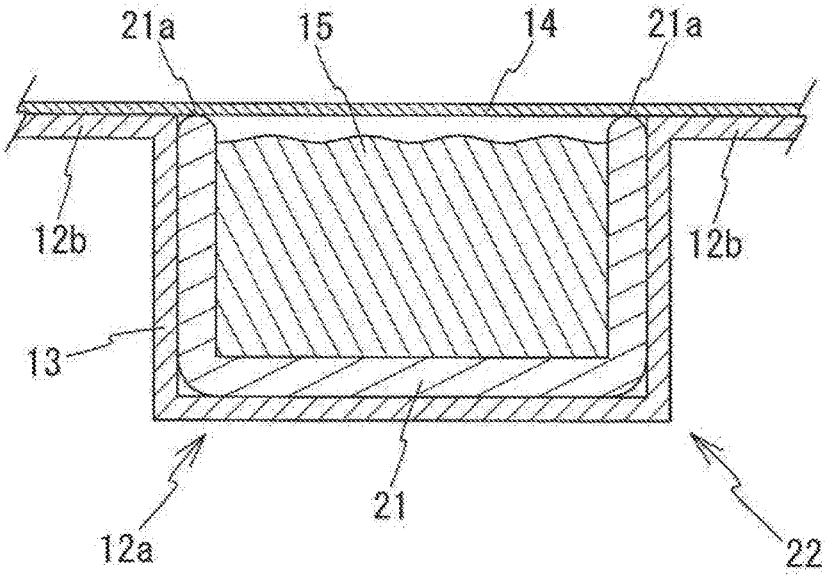
FIG. 13A is a cross-sectional view of a PTP sheet according to a fourth embodiment of the present invention.
Figure 13B:
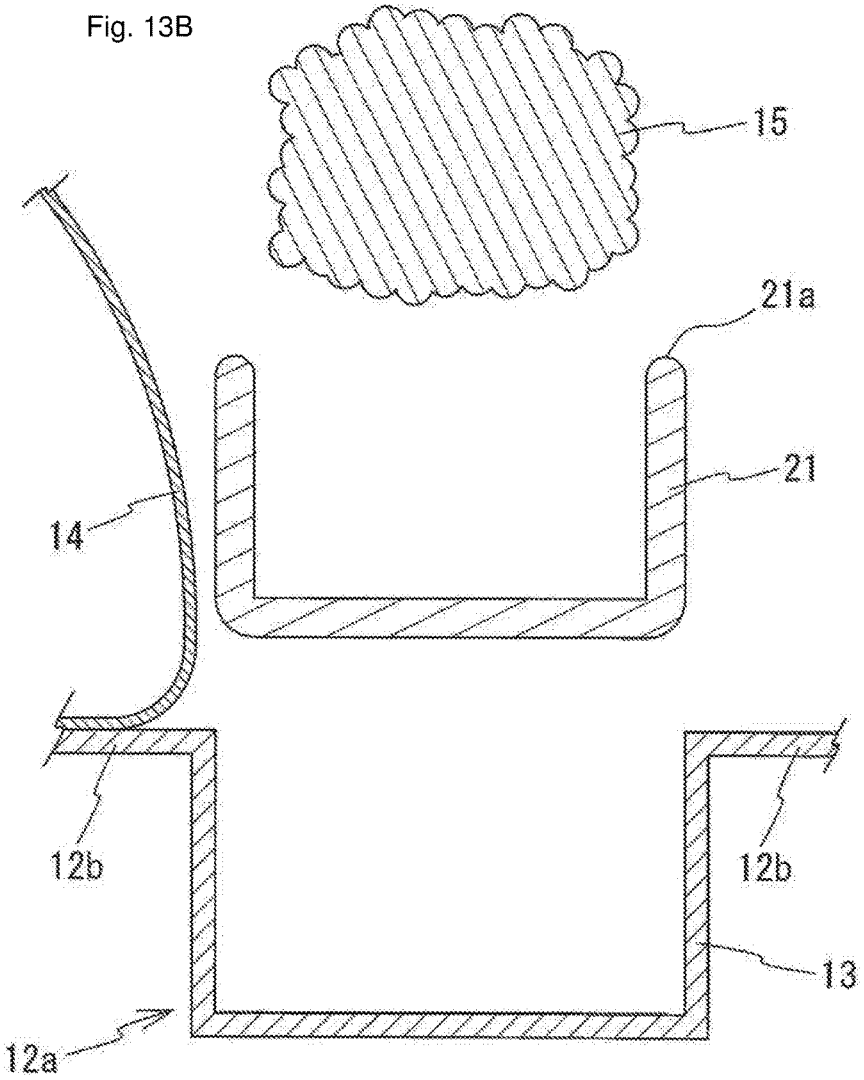
FIG. 13B is an exploded view of the PTP sheet.
Figure 14B:
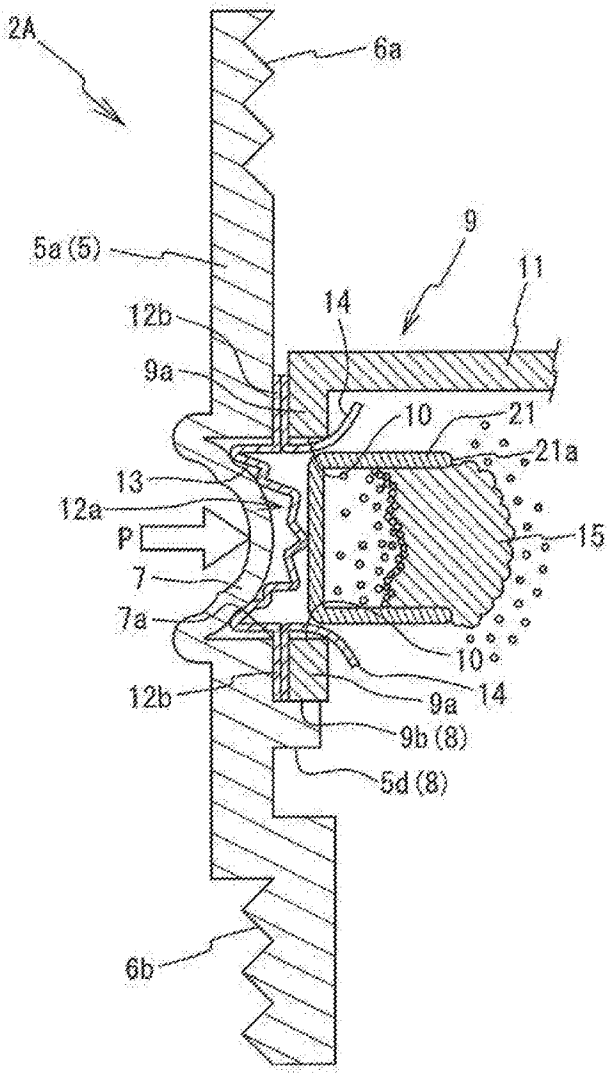
FIG. 14B is a partial cross-sectional view of the mixing container, showing a stored substance being released from the PTP sheet into a body.
Figure 14A:
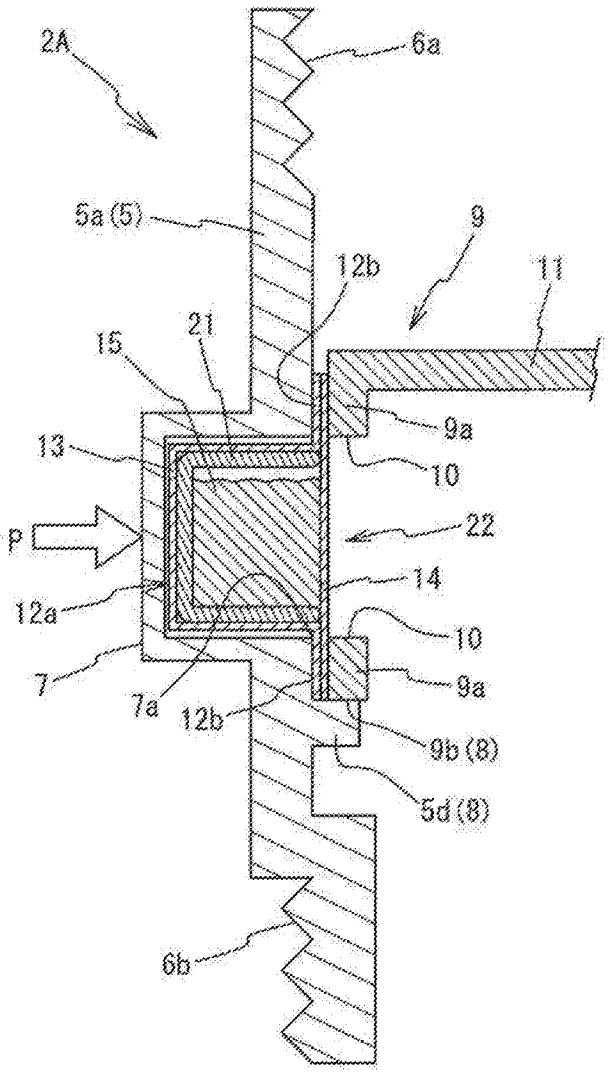
FIG. 14A is a partial cross-sectional view of the mixing container according to the first embodiment of the present invention with the PTP sheet and a support according to the fourth embodiment of the present invention installed on the mixing container.

FIG. 13A is a cross-sectional view of the PTP sheet according to the fourth embodiment of the present invention. FIG. 13B is an exploded view of the PTP sheet. FIG. 14A is a partial cross-sectional view of the mixing container according to the first embodiment of the present invention with the PTP sheet and a support according to the fourth embodiment of the present invention installed on the mixing container. FIG. 14B is a partial cross-sectional view of the mixing container, showing a stored substance being released from the PTP sheet into a body. The components that are also shown FIGS. 1 to 12 are given the same reference numerals, and will not be repeatedly.

A PTP sheet 22 according to the fourth embodiment is used for the mixing containers 2A to 2C' according to the first to third embodiments. More specifically, the PTP sheet 22 according to the fourth embodiment is an improvement on the PTP sheet 12 shown in FIGS. 4A to 4E and used in the mixing containers 2A to 2C' according to the first to third embodiments.

More specifically, as shown in FIGS. 13A and 13B, the PTP sheet 22 according to the fourth embodiment includes a storage pack 13 having a recessed cross section, formed from a synthetic resin deformable by a finger operation, and having an integrated edge 12*b* on its rim, as a flange, an inner pack 21 having a recessed cross section, formed from a synthetic resin undeformable by a finger operation, and contained in the storage pack 13, a powder or liquid substance 15 stored in the inner pack 21, and a film 14 that seals the opening of the storage pack 13 containing the stored substance 15 and the inner pack 21.

The use of the PTP sheet 22 according to the fourth embodiment will now be described in detail with reference to FIGS. 14A and 14B.

The PTP sheet 22 according to the fourth embodiment may be used in the same manner as the known PTP sheet 12 shown in FIGS. 4A to 4E. The use of the PTP sheet 22 according to the fourth embodiment in the spray container 1A according to the first embodiment will now be described as an example.

To release the stored substance 15 from the PTP sheet 22 according to the fourth embodiment into the hollow of the body 5 in the spray container 1A according to the first embodiment, the storage pack 13 of the PTP sheet 22 is placed in the hollow 7*b* of the receiving chamber 7, and the support 9 is installed adjacent to the film 14 of the PTP sheet 22 as shown in FIG. 14A. This completes the installation of the PTP sheet 22 in the body 5 (refer to FIG. 14A).

Then, the receiving chamber 7 in the state shown in FIG. 14A may be pushed toward the hollow of the body 5 to compress the receiving chamber 7 from outside. In other words, the receiving chamber 7 containing the PTP sheet 22 may be pushed in the direction of arrow P in FIG. 14A.

This action forces the inner pack 21 contained in the storage pack 13 into the hollow of the body 5, causing the inner pack 21 to burst the film 14 with its opening 21*a* from inside. As shown in FIG. 14B, this releases the stored substance 15 into the hollow of the body 5 together with the inner pack 21.

The inner pack 21 released into the body 5 can be easily separated from the dissolving agent and the stored substance 15, and may thus mix with the dissolving agent and the stored substance 15 without trouble in the body 5.

Although FIGS. 14A and 14B illustrate the use of the PTP sheet 22 according to the fourth embodiment in the mixing container 2A according to the first embodiment, the PTP sheet 22 may also be used appropriately in the mixing containers 2B to 2C' according to the other embodiments of the present invention.

The PTP sheet 22 according to the fourth embodiment described above, which includes the inner pack 21, allows the stored substance 15 in the storage pack 13 to be released into the body 5 without remains, unlike the PTP sheet 12 shown in FIGS. 4A to 4E.

This allows a mixture of the stored substance 15 and the dissolving agent with a specified concentration to be prepared in the body 5 with higher concentration accuracy.

Thus, the PTP sheet 22 according to the fourth embodiment improves the convenience of the mixing containers 2A to 2C' according to the first to third embodiments.

INDUSTRIAL APPLICABILITY

As described above, the aspects of the present invention provide a reusable mixing container that allows powder, liquid, or solid substances stored separately in a body to be released into the body by an external operation, a spray container including the mixing container, and a PTP sheet for the mixing container and the spray container. These are usable in technical fields including daily necessities, medical supplies, or tools for research.

REFERENCE SIGNS LIST

1A spray container
1B spray container
2A mixing container
2B mixing container
2B' mixing container
2C mixing container
2C' mixing container
3*a* spray nozzle
3*b* spray nozzle
4*a* lid
4*b* lid
5 body
5*a* first part
5*b*$_1$ second part
5*b*$_2$ second part
5*c* opening
5*d* protrusion (fitting portion)
6*a* connection section (first connection section)
6*b* connection section (first connection section)
7 receiving chamber
70*a* receiving chamber
70*b* receiving chamber
7*a* inlet
7*b* hollow
7*c*$_1$ protrusion
7*c*$_2$ protrusion
8 holding structure
9 support
9*a* plate
9*b* notch (fitting portion)
10 releasing hole
11 reinforcement
12 PTP sheet
12*a* storage portion
12*b* edge
12*c* separation line
12*d* piece
13 storage pack
14 film

15 stored substance
15*a* powder or liquid (stored substance)
15*b* molded substance (stored substance)
16 body
16*a* opening
16*b* fitting recess
16*c* fitting groove
16*d* fitting receiving portion
16*e* second thread
17 support
17*a* tab
17*b* fitting ridge
17*c* lower end
17*d* third thread
17*e* receiving chamber edge
17*f* flexible portion
17*g* plate
18 lower end portion
18*a* first thread
19 opening
20 connection section (second connection section)
21 inner pack
21*a* opening
22 PTP sheet

The invention claimed is:

1. A mixing container, comprising:

a body having an upper opening and configured to contain a dissolving agent;

at least one receiving chamber protruding outward from an inner peripheral surface of the body, and having a hollow in which a press-through pack (PTP) sheet is fittable from inside the body, the at least one receiving chamber comprising a flexible material;

a support including a plate and a releasing hole configured to communicate with an inlet of the hollow when the plate is installed on the inner peripheral surface of the body and allow a substance stored in the PTP sheet to be released into the body, the support being configured to hold an edge of the PTP sheet between the inner peripheral surface of the body and the plate; and a holding structure configured to hold the support on the inner peripheral surface of the body, wherein the holding structure includes a fitting structure for the body and the support.

2. The mixing container according to claim 1, wherein the body further includes a plurality of the receiving chambers that are arranged in series circumferentially around a middle part of the body, and the support is annular and further includes the releasing hole corresponding to the inlet of each of the receiving chambers and a reinforcement supporting the annular support across a hollow of the support.

3. The mixing container according to claim 2, wherein the body includes a first part having the receiving chambers, second parts other than the first part, and first connection sections into which the first part and the second parts are screwed together.

4. The mixing container according to claim 1, further comprising:

a lid attached to the opening of the body and having a first thread on an outer peripheral surface of a vertically lower end portion of the lid, wherein the body further includes a fitting recess at the opening of the body and finable on a vertically upper end of the support, a fitting receiving portion on the inner peripheral surface of the body and configured to receive a lower end of the support, and a second thread on the inner peripheral surface of the body and adjacent to the opening, the support further includes a third thread configured to circumferentially connect with the second thread when the support is fitted on the fitting recess of the body, and a flexible portion adjacent to an insertion portion of the lower end of the support to be received in the fitting receiving portion and allowing the support to be tilted toward a center of the body, and the holding structure further includes a second connection section in which the first thread and the second and third threads are screwed together.

5. The mixing container according to claim 1, wherein the body further comprises a light transmissive material allowing an uppermost level of the dissolving agent to be visually observed from outside, and is graduated to indicate an amount of the contained dissolving agent.

6. The mixing container according to claim 1, wherein the receiving chamber includes at least one protrusion extending from an inner surface defining the hollow in a direction of pressing the receiving chamber.

7. A spray container, comprising:

the mixing container according to claim 1; and a spray nozzle directly or indirectly installed in the mixing container.

* * * * *